US006179140B1

(12) United States Patent
Gardner

(10) Patent No.: US 6,179,140 B1
(45) **Date of Patent: *Jan. 30, 2001**

(54) CORK REMOVAL APPARATUS

(76) Inventor: William A. Gardner, 6950 Yount St., Yountville, CA (US) 94599

( * ) Notice: Under 35 U.S.C. 154(b), the term of this patent shall be extended for 0 days.

This patent is subject to a terminal disclaimer.

(21) Appl. No.: 09/273,838

(22) Filed: Mar. 22, 1999

Related U.S. Application Data

(63) Continuation-in-part of application No. 08/746,799, filed on Nov. 18, 1996, now Pat. No. 5,884,789.

(51) Int. Cl.[7] ..... B65D 39/00

(52) U.S. Cl. ..... 215/299; 215/211; 215/215; 81/3.45

(58) Field of Search ..... 215/296, 297, 215/299, 364, 211, 215; 81/3.45, 3.48, 3.49

(56) References Cited

U.S. PATENT DOCUMENTS

| | | | |
|---|---|---|---|
| 773,857 | 11/1904 | Effenberger . | |
| 778,593 | 12/1904 | Maconnell . | |
| 884,322 | 4/1908 | Deusch | 215/299 |
| 1,204,712 | 11/1916 | Spelling . | |
| 1,416,616 | 5/1922 | Crane | 215/299 X |
| 1,464,646 | 8/1923 | Cross | 215/299 X |
| 3,307,727 | 3/1967 | Garay | 215/299 |
| 4,889,251 | 12/1989 | Hojnoski . | |

FOREIGN PATENT DOCUMENTS

| | | |
|---|---|---|
| 197203 | 9/1907 | (DE) . |
| 297516 | 4/1917 | (DE) . |
| 2 280 | 3/1904 | (FR) . |
| 2766163 | 1/1999 | (FR) . |
| 128179 | 7/1919 | (GB) . |

*Primary Examiner*—Stephen K. Cronin
(74) *Attorney, Agent, or Firm*—John P. O'Banion

(57) ABSTRACT

An apparatus for removing a cork from a bottle in which an anchor is embedded in the cork and a cork-pulling handle is provided for engaging the anchor for removal of the cork. The cork-pulling handle can be connected to the anchor by any of several means, and can be stored with the bottle as an integral part of the bottle/capsule/label package or provided separately.

18 Claims, 25 Drawing Sheets

CORK REMOVAL APPARATUS

CROSS-REFERENCE TO RELATED APPLICATIONS

This application is a continuation-in-part of application Ser. No. 08/746,799 filed on Nov. 18, 1996, now U.S. Pat. No. 5,884,789.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to devices and methods for removing corks from bottles, and more particularly to a cork removal apparatus in which an anchor is integrated with the cork in the bottling process, in which the cork is extracted with a cork-pulling handle that is packaged with the bottle or provided separately, and in which the cork-pulling handle is coupled to the anchor during bottling or later by the consumer.

2. Description of the Background Art

Wine and a few other beverages are typically packaged in glass bottles that are sealed with a cork stopper. Although "easy-open" containers such as snap-top cans and screw-cap bottles are well known, there are several reasons why easy-open technologies have not been widely adopted in the wine industry. Two particularly salient reasons are that (i) the aesthetic appeal of corked bottles is important to wine consumers, and (ii) no completely adequate means for quick and easy removal of corks, without the use of awkward, cumbersome, or clumsy auxiliary cork removing devices (such as cork screws, cork pullers, pressure pumps, etc.), has yet been invented.

A completely adequate means for quick and easy removal of corks from wine bottles must meet four basic requirements. The first is that the cork must provide an adequate seal against the inside walls of the neck of the bottle. The second is that a permanently installed pulling device must not protrude through the bottom or sides of the cork and it must not split or tear the cork because of the likelihood of resultant wine leakage and/or wine contamination. The third is that the cork and cork-puller installation into the wine bottle must not unduly complicate the present bottle-corking technology used throughout the industry. The fourth is that the cork must be easily extractable by the consumer without the use of cumbersome, awkward, or clumsy auxiliary devices. These requirements, however, tend to work against one another.

For example, the better the cork/glass seal is, the harder it is to extract the cork. For example the pulling force can increase by as much as 20 kg, or more, due to the addition of adequate amounts of paraffin wax for sealing. The only known viable prior device for quick and easy cork removal without a separate apparatus is the "cork stopper for bottles of wine" described in U.S. Pat. No. 4,889,251 issued to Hojnoski on Dec. 26, 1989. The Hojnoski device comprises an integrated cork and puller that enables the wine consumer to quickly and easily remove the cork, provided that the cork is sufficiently well coated with a lubricating agent such as silicone. However, with adequate lubricant, the cork/glass seal obtained is not as good as it should be because it is not possible to use enough wax in the cork coating. That is, it is wax that provides a good cork/glass seal. However, wax acts counter to the silicone lubricant and makes the cork stick to the glass. Consequently, if enough wax is used to provide a good seal, the pulling force required to extract the cork (which would normally be as high as 35 kg to 40 kg) using the Hojnoski device is too great. This results from the fact that Hojnoski uses a pulling device that is part of the cork unit, as desired, but because of this it is so small that only two fingers can be used for the pulling operation. With only two fingers, pulling forces in excess of about 20 kg would not be possible for many consumers. In addition, the Hojnoski device, by its nature, is too fragile to reliably withstand more than a pulling force of about 35 kg. This is due in part to a fundamental element of its design, namely the use of a hollow plastic cylinder for anchoring the cork, which enables the insertion of a pulling device into the anchor that can slide up and down to accommodate both operational and storage positions.

Another example of an attempt to provide a cork stopper with a self-contained pulling device can be seen in U.S. Pat. No. 1,204,712 issued to Spelling. There are several reasons why the Spelling device is not viable, including the fact that it is not designed for high-speed bottling/corking equipment, and the requirement of a degree of elasticity and tensile strength of the stopper that exceeds that of cork resulting in a significant likelihood of the cork splitting during corking and, as a result, the wine leaking and becoming subject to contamination.

Therefore, a need exists for a self-contained cork and cork-removal apparatus that allows for "easy extraction" of the cork while still providing an adequate cork/glass seal that meets the four basic requirements outlined above. As used herein, "easy extraction" means that no cumbersome, awkward, or clumsy auxiliary equipment, such as cork screws that must be screwed into the cork by the consumer, blade style cork removers that require inserting a pair of blades between the cork and bottle, or air-pump cork removers that require a needle to be forced through the cork and air pumped into the bottle to increase pressure, and so on, is required of the consumer, and that adequate pulling forces are as easily applied as with conventional cork screws. The present invention satisfies these needs, as well as others, and overcomes the deficiencies of previously developed cork removal devices.

SUMMARY OF THE INVENTION

The foregoing needs are addressed by the present invention which generally comprises a cork anchor and an attached or detached cork-pulling handle that can withstand the required pulling forces while allowing the consumer to use more than two fingers to pull the cork out of the bottle, thereby enabling the consumer to apply pulling forces just as large as those currently being used with prior art auxiliary cork screws. This in turn allows the wine producer to use conventional cork coatings that provide a good wine seal. In addition, the present invention will have little or no impact on the high-speed mechanized corking equipment widely used in the industry, and does not introduce means by which the wine can be contaminated.

By way of example, and not of limitation, the present invention generally comprises a composite cork and cork-removing unit having two components. One component is the cork, in which an anchor for a cork-pulling handle is secured. The second component is a cork-pulling handle which can be connected to the anchor by any of several means, and which can be stored with the bottle as an integral part of the bottle/capsule/label package, or can be supplied separately.

In accordance with one embodiment of the invention, the top of the anchor is approximately flush with the top of the cork. The top of the anchor contains an eye, or other female, or male, part of a latch which can be hooked or otherwise connected to a mating part of a latch, using the stem of a detached pulling handle which contains the hook or other female, or male, latch at its end. The handle/stem combination can, as an example, resemble the basic T-shaped cork screw except, in place of a screw at the end of the stem, there is simply a hook. Also, the stem is joined to the handle with a hinged joint that allows the stem to be folded up against and co-linear with the handle. When folded into this compact storage configuration, the pulling handle can be stored against the side of the bottle neck, parallel to the bottle axis and congruent with the circumference of the bottles' neck. In any of the storage positions, the handle can be secured with any of various conventional means such as a plastic ribbon around the bottle, or with a quick release device like a rip tab that tears along a perforation.

In accordance with another embodiment of the invention, the top of the anchor is permanently connected to the stem or the lengthwise center of a pulling handle with a flexible cord or strap having adequate tensile strength to withstand a pulling force of approximately 40 kg. The pulling handle can be a separate handle that is stored in the position described above, or it can be integrated with the wrapper which covers the top part of the neck of the bottle so that the wrapper, designed with adequate stiffness and gripping length, becomes the pulling handle.

The pull cord or strap is fastened to the anchor using any of numerous conventional methods. For example, one end of the cord could be looped through an eye at the top end of the anchor and then clamped to the cord. A similar connection can be made on the pulling handle. Alternatively, the pulling handle can be soft, rather than stiff (as needed when the cord is connected at the lengthwise center) in which case the cord would run through the handle, emerging from both ends. This latter approach also can be integrated with the wrapper by using a capsule style wrapper formed by two halves with a hinge. When two packaging rip tabs are pulled, the wrapper can be folded open into a handle positioned perpendicular to the axis of the bottle and twice the length of the original wrapper. By using a folding crease as a hinge across the disk-shaped top of the wrapper and extending between the two tops of the two rip-tab paths, the opening operation is facilitated. By threading a cord through the two pieces of this handle, and connecting it to the anchor so that the handle naturally rotates 180° as one prepares to pull the cord, we obtain a handle that comfortably fits the hand.

In accordance with another embodiment of the invention, the bottle-neck wrapper is integrated with the pulling handle, but there is no cord involved and there is no connection operation to be performed by the consumer. Rather, the connection between the anchor in the cork and the pulling handle is made when the handle/wrapper combination is applied to the bottle during production. For example, from the operational position, the handle can be foldable in one direction, so that it can be wrapped over the top of the bottle, but not foldable in the opposite direction so that, in the operational position, the handle is stiff enough to enable the user to execute the necessary pull using a three- or four-finger grip.

In accordance with an additional set of embodiments a cork anchor is used wherein the head section of the anchor is substantially flat and circular and is raised above the cork body so that a gap exists between the cork and the anchor head area, this gap allows the bottle to breath and facilitates the attachment of the cork pulling handle. A removable packaging ring is added, that surrounds the raised head of this anchor wherein the top of the ring is substantially flush with the top of the anchor head and aligned with the diameter of the bottle neck. The ring provides a tamper seal while offering a more attractive and smoother wrapper presentation on the top of the bottle.

In accordance with another embodiment of the invention, a pivoting handle assembly is provided to give the person pulling the cork an ability to rotate the handle during cork extraction, while it additionally allows the cork pulling device to be folded up and affixed to the side of the bottle without any portion of the cork-pulling device extending above the top of the bottle or extending outwardly beyond the largest diameter of the bottle.

In accordance with another embodiment of the invention, a lever arm is pivotally attached to one end of an extendable pivoting handle assembly, to provide the person pulling the cork with additional leverage and control. As the user pulls on the extended handle the lever arm forms a fulcrum against the top ridge of the bottle so that the cork is removed with less pulling force. The extendable handle and lever arm all fold together and can be affixed to the side of the bottle without any portion of the cork-pulling apparatus extending above the top of the bottle nor extending outwardly beyond the largest diameter of the bottle.

In accordance with another embodiment of the invention a simpler one piece puller handle is employed that contains a slotted-hole for engaging the head of the cork anchor. The handle can be stored alongside the neck of the bottle.

In general, any method of cork-pulling, such as lever-type pullers and geared pullers, can employ this invention by providing a means, such as a hook or slidable catch slot, for attaching the cork-pulling handle to the anchor in the cork.

An object of the invention is to provide for the easy and convenient removal of a cork from a bottle.

Another object of the invention is to provide a cork removal apparatus that can be easily packaged with a bottle.

Another object of the invention is to avoid the requirement that the consumer perform the operation of anchoring a pulling device to the cork.

Another object of the invention is to avoid the requirement that the consumer force a device through, into, or along the sides of the cork.

Another object of the invention is that the consumer only be required to perform a simple straight pulling operation in order to uncork the bottle.

Another object of the invention is that the consumer not be required, after uncorking a bottle, to unscrew a corkscrew or similar means from the cork.

Another object of the invention is to provide a cork removal apparatus that can be manufactured at a sufficiently low cost for use as a disposable cork removal device.

Another object of the invention is to provide a cork removal apparatus that can be employed with corks of various styles, compositions, and manufacture including natural corks, synthetic corks, agglomerated natural corks, and others.

Another object of the invention is to provide compatibility with a wide variety of cork pulling devices including straight pulling, lever pulling, geared pulling, high speed production pullers, and others.

Another object of the invention is to eliminate mishaps whereby the "cork-screw" mechanism of rapid cork removal devices pulls back out and of the cork while leaving the cork still in the bottle.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
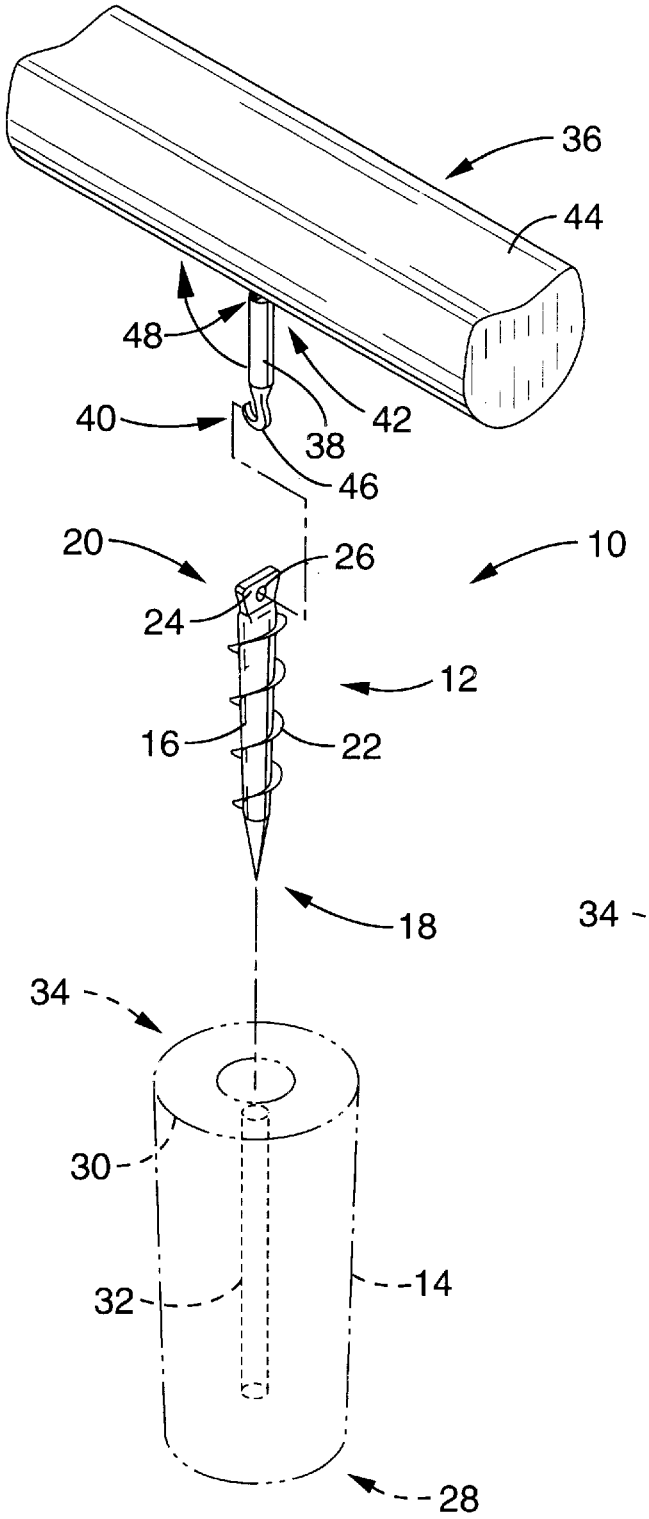
FIG. 1 is a perspective exploded view of a cork removal apparatus acording to the invention shown in combination with a hook-and-eye style of cork pulling anchor and its associated cork.
Figure 2:
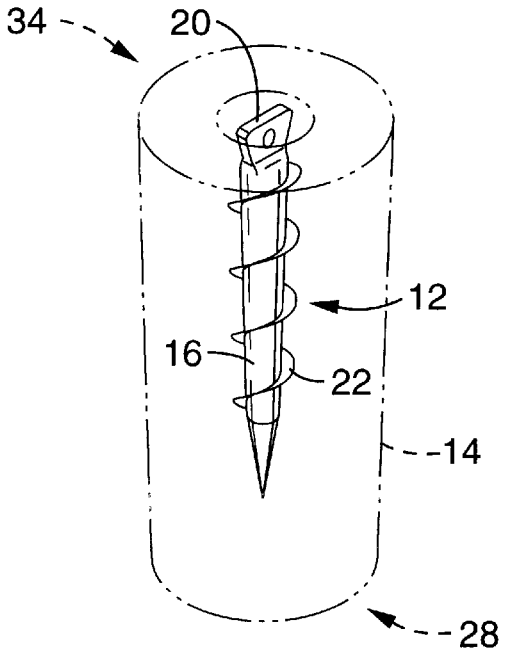
FIG. 2 is an assembled perspective view of a cork pulling anchor of FIG. 1 inserted into its associated cork.
Figure 3:
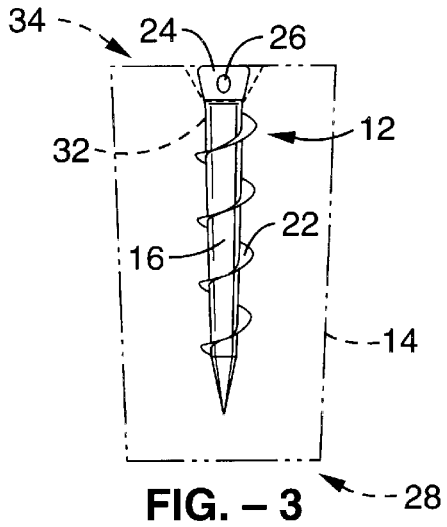
FIG. 3 is a front view of the assembly shown in FIG. 2, depicting the cork pulling anchor embedded in its associated cork.

Referring more specifically to the drawings, for illustrative purposes the present invention is embodied in the apparatus generally shown in FIG. 1 through FIG. 37, where like reference numerals denote like parts. It will be appreciated that the apparatus may vary as to configuration and as to details of the parts without departing from the basic concepts as disclosed herein.

Referring first to FIG. 1 through FIG. 4, a cork removal apparatus 10 in accordance with the present invention includes an anchor 12 which is configured to be embedded into a cork 14. As used herein, the term "cork" means natural or synthetic corks, including plastic corks, agglomerated natural corks, foam corks and the like. Anchor 12 comprises an elongated tapered shank 16 having first and second ends 18, 20, respectively, and spiral threads 22 around the circumference of shank 16 extending between first and second ends 18, 20. Shank 16 may or may not be tapered toward distal end 18, and the proximal end 20 includes an eye 24 which provides an opening 26 therein. The eye shown in the head of the anchor is only slightly larger than the shank, providing just enough material around the eye to withstand approximately 40 kg of pulling force, along with the amount of twisting torque that is applied when the anchor is initially screwed into place within the cork.

Because anchor 12 will remain in cork 14 for extended periods of time during storage, the integrity of cork 14 must not be compromised when an anchor is inserted. Consequently, the bottom 28 and outside circumference 30 of cork 14 must not be broken through. Also, little or no tearing or splitting should occur in the interior of cork 14. Thus, some conventional screw designs will not suffice for anchor 12.

The preferred manner of meeting the foregoing requirements, while insuring that anchor 12 is sufficiently secured in cork 14 to withstand a pulling force of approximately 40 kg, is to install the anchor as follows. An optional pilot hole 32 approximately 2 mm in diameter can be drilled at, or near, the center of the top 34 of cork 14, and down the longitudinal axis to approximately 10 mm from the bottom 28 of cork 14. To prevent cork 14 from splitting adjacent to the protruding threads 22, the overall diameter of shank 16 and threads 22 should not exceed approximately 9.0 mm for a pilot hole that size. The diameter of shank 16 should be approximately 3.0 mm to 4.0 mm and the protrusion of threads 22 from shank 16 should not exceed approximately 2.0 mm to 2.5 mm on each side of the shank. Furthermore, to prevent or minimize cork tearing between the threads when anchor 12 is pulled on, there should be approximately 8.0 mm of separation between threads. In this manner, anchor 12 is specially designed so that it can be screwed into the cork, with or without, the pilot hole 32 so as not to tear or split the cork. It will be appreciated that the exact dimensions to be used can be adjusted to accommodate the desired range of natural cork grades and desired variety of agglomerated and synthetic cork types.

To facilitate removal of cork 14 once the bottle is corked, a cork-pulling handle 36 is provided which can be connected to anchor 12 by any of several methods, and which can be stored with or separately from the bottle. Referring to FIG. 1, cork-pulling handle 36 is shown as comprising an elongated stem 38 having first and second ends 40, 42, respectively, and an elongated gripping member 44 coupled to the proximal end 42 of stem 38. Located at distal end 40 is an arcuate hook 46 that is configured to be received through opening 26 in eye 24 of anchor 12. The grip/stem combination can, as an example, resemble the basic T-shaped cork screw except that, in place of a screw at the end of the stem, there is simply a hook. Preferably, gripping member 44 should be sufficiently long to accommodate a three- or four-finger grip and approximately the diameter of a cork to provide a comfortable gripping surface. Note also that gripping member 44 is slightly concave on one side so that it will follow the contour of the side of a bottle for packaging, and stem 38 includes a hinged joint 48 so that the handle can be folded down for compactness packaged in that manner. A variety of other means to couple the cork-pulling handle 36 to anchor 12 could be substituted. When hook 46 engages eye 24 and a sufficient pulling force is applied along the longitudinal axis of stem 38, the cork 14 is thereby removed from the bottle.

Figure 4:
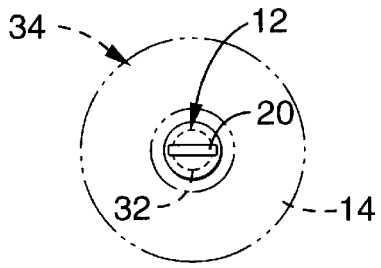
FIG. 4 is a plan view of the assembly shown in FIG. 2 and FIG. 3.

With regard to production and assembly, cork 14 can be optionally drilled and anchor 12 screwed into the drilled pilot hole 32, as previously described, either prior to, or after, corking the bottle. The cork anchor 12 is shown assembled into the cork 14 in FIG. 2, such that the pilot hole 32 has been fully filled, leaving no void below the anchor 12 while providing sufficient clearance from the bottom 28 of the cork 14 to prevent splitting and leakage. If the cork anchor 12 is inserted into the cork 14 before the normal corking process the radial compression of the cork prior to insertion further secures the anchor 12 within the cork 14. The bottler or manufacturer may additionally choose to coat either the anchor or the optional pilot hole, with one or more materials to reduce cork tearing upon anchor insertion and to enhance security of the anchor to cork connection. While threads 22 are preferred for securing the anchor 12 to the cork 14, other securing mechanisms contemplated include ribs, barbs, and protrusions. The same style of cork anchor 12 in FIG. 1 is shown in the side view of FIG. 3 screwed into the cork 14. The eye 24 and opening 26 for hook attachment are easily seen, whereas a "V-shaped" recess is seen that was created when the optional pilot hole was drilled. The top of the eye 24 of the cork anchor 12 is seen substantially flush with the top of the cork. A top view of the anchor within a cork 14 is shown in FIG. 4 where the head of the cork anchor 12 is seen extending from a recess created by pilot hole 32 drilling.

Referring to FIG. 1, it will also be appreciated that hook 46 and eye 24 can be varied in a number of ways and are only examples of coupling mechanisms that could be employed. The eye section can be in a head that is only slightly larger than the shank and provides just enough material to withstand approximately 40.0 kg of pulling force, as well as the twisting torque that occurs when the anchor is screwed in to place. The eye section can be in a large head that extends above the cork and thus can serve additional functions such as that of providing a visual enhancement.

Figure 5:
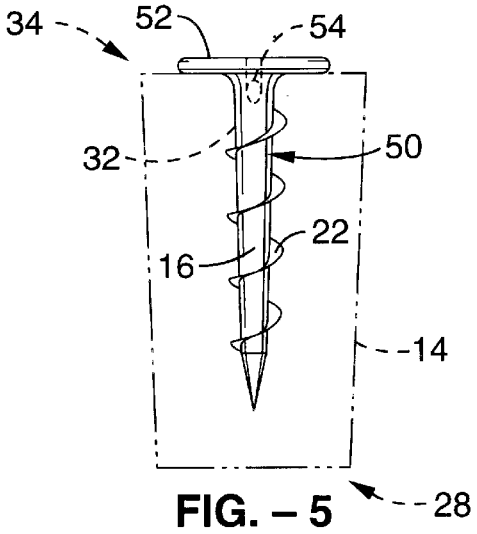
FIG. 5 is a front view of an alternative embodiment of the assembly shown in FIG. 2 through FIG. 4 showing a cork anchor having a flat head section with a hole.
Figure 6:
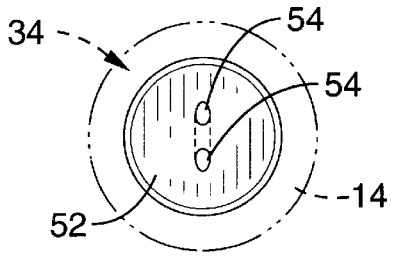
FIG. 6 is a plan view of the assembly shown in FIG. 5.

Another embodiment of the "eye" style anchor is shown in FIG. 5 and FIG. 6. The anchor 50 of FIG. 5 is embedded in the cork 14 and has a flat substantially circular head section 52 with an eye created by the hole 54 that enters and exits the top part of the anchor. The hook on a handle apparatus is slid through the eye hole 54 in order to make the connection for cork extraction.

Figure 7:
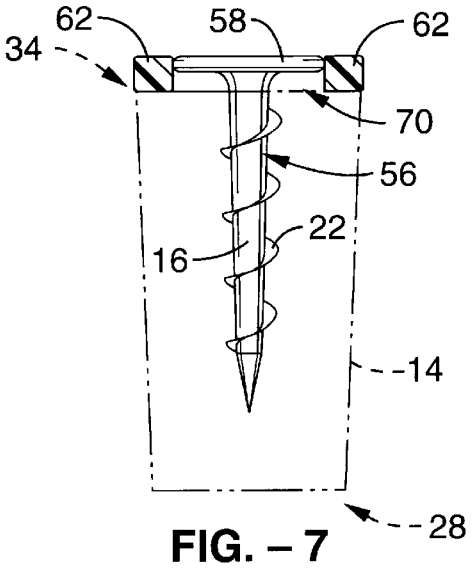
FIG. 7 is a front view of an alternate embodiment of the assembly shown in FIG. 5 and FIG. 6 showing a cork anchor having a flat head section with a gap under the anchor head and including a packaging ring.
Figure 8:
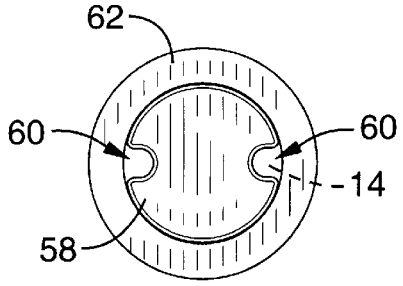
FIG. 8 is a plan view of the assembly shown in FIG. 7.

Another embodiment of a different anchor style is shown in FIG. 7 and FIG. 8. The anchor 56 is shown embedded in the cork 14 with a gap 70 between the head 58 of the anchor 56 and the cork 14. The gap is accessed by the pulling handle to connect with this style of cork anchor to effect cork removal. A packaging ring 62 is shown encircling the flat head 58 of the anchor 56. A simple packaging ring is shown that provides for a smooth flush contour of the wrapper that is used over the neck of many bottles. The packaging ring could alternately be formed in various ways to provide other decorative effects. The head 58 of the anchor 56 shown in FIG. 8 contains cutouts 60 that are used for applying torque to the anchor 56 to facilitate the process of assembling the anchor 56 into the cork 14. The packaging ring 62 can be seen surrounding the anchor head 58.

Figure 9:
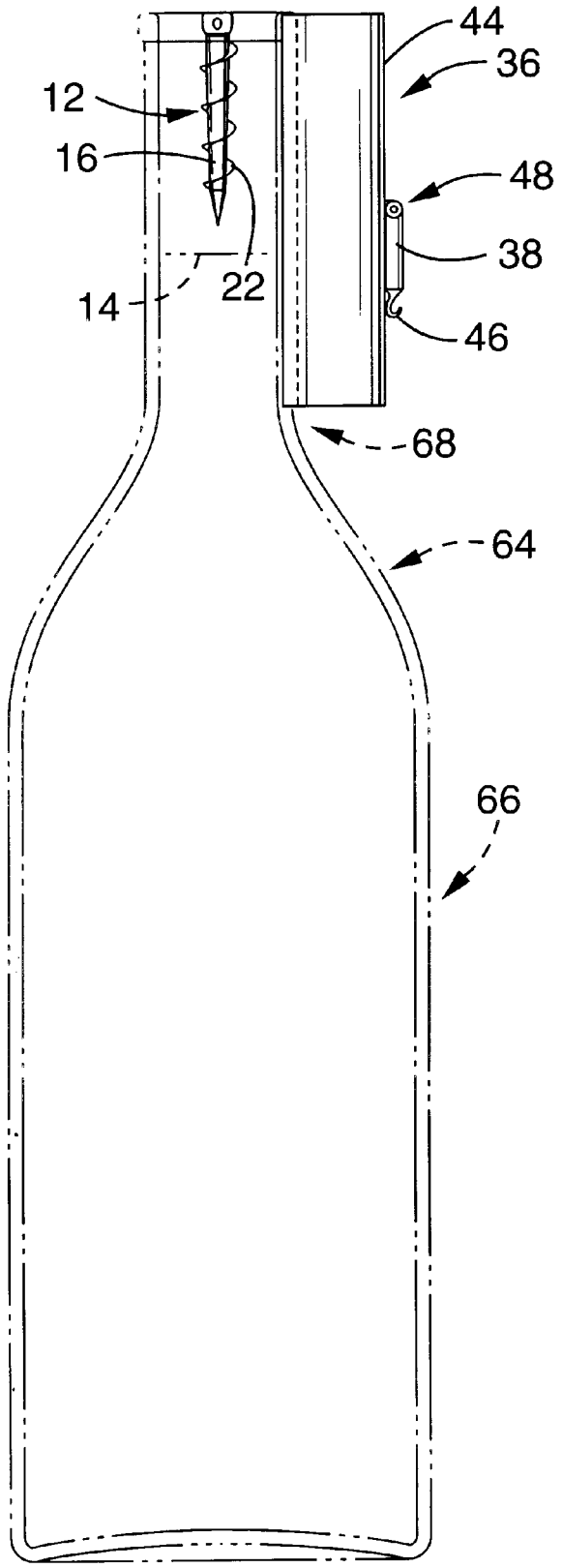
FIG. 9 is an elevation view of a bottle showing the cork pulling handle portion of the apparatus shown in FIG. 1 stored along the neck of the bottle.

In order to facilitate the packaging of the cork-pulling apparatus of FIG. 1 with a wine bottle in a convenient and aesthetically pleasing manner the pulling stem can be folded co-linearly with the handle. Referring now to FIG. 9, when the handle is folded into this compact storage configuration, it can be stored parallel to the longitudinal axis of the bottle and congruent with the circumference of the neck of the bottle, and may be stored against the shoulder 64 of the bottle 66, or along the neck 68 of the bottle 66 as depicted in FIG. 9. The cork-pulling handle can be secured with any of various conventional means such as a plastic ribbon (not shown) around the bottle, with a quick release device like a rip tab (not shown) that tears along a perforation.

Figure 10:
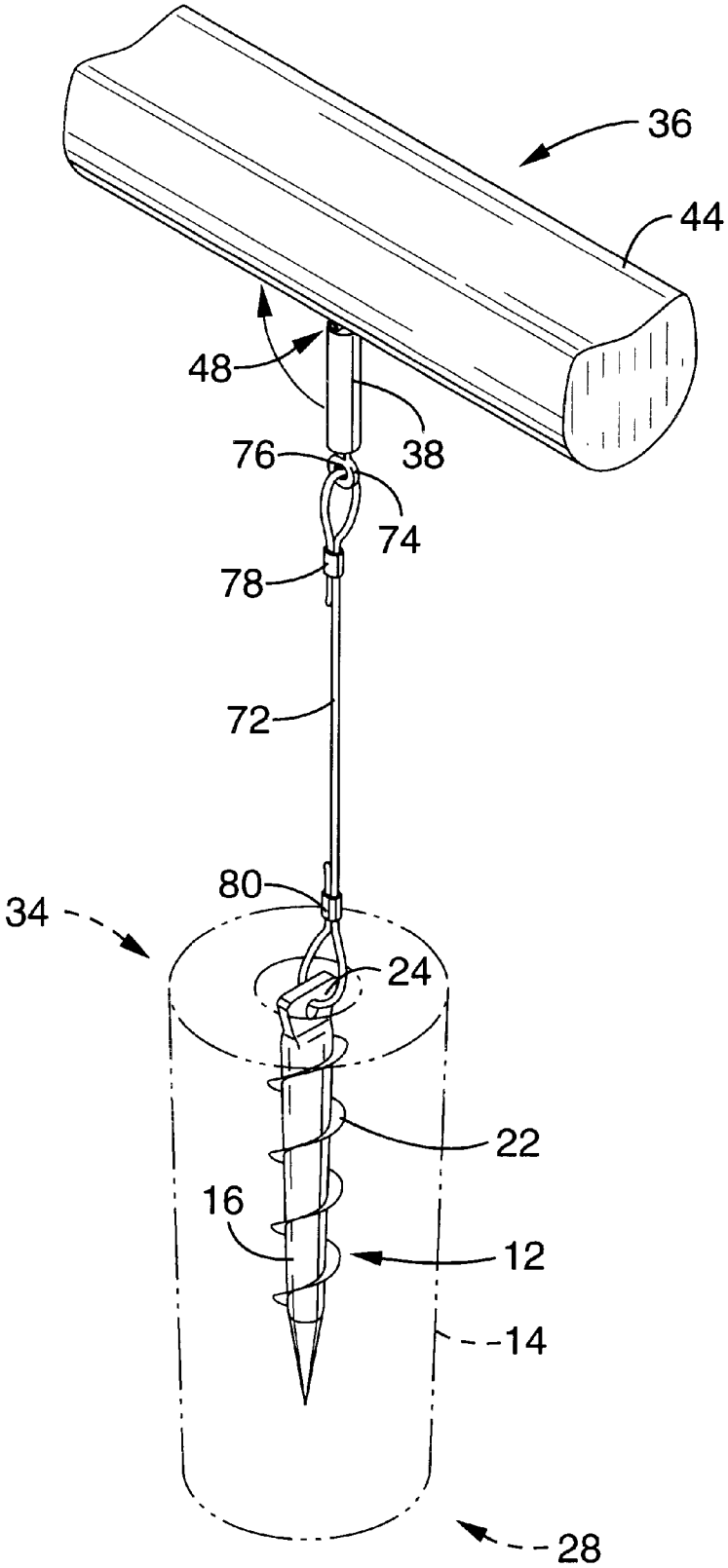
FIG. 10 is a perspective assembled view of the cork removal apparatus of FIG. 1, in which the handle portion is coupled to the cork anchor using a cord.

Referring now to FIG. 10, an alternative embodiment of the invention is shown in which a flexible cord or strap 72 having an adequate tensile strength to withstand a pulling force of approximately 40.0 kg is used to permanently couple anchor 12 to cork-pulling handle 36. In the embodiment shown, hook 46 has been replaced with an eye 74 having an opening 76 through which the cord 72 is threaded and fastened with a conventional clamp 78 or the like. The other end of the cord 72 is threaded through the eye 24 in anchor 12 and held in place with another conventional cord clamp 80 or similar fastening device. It will also be appreciated that other types of connectors could be substituted for eye 24 and eye 74 in this embodiment, and that other conventional means for coupling anchor 12 to cork-pulling handle 36 could be used as well, including chains and flexible cables. It will also be appreciated that cork-pulling handle 36 can be stored in the position shown in FIG. 9 with cord 72 and cork-pulling handle 36 secured to the bottle in the same manner described above.

Figure 11:
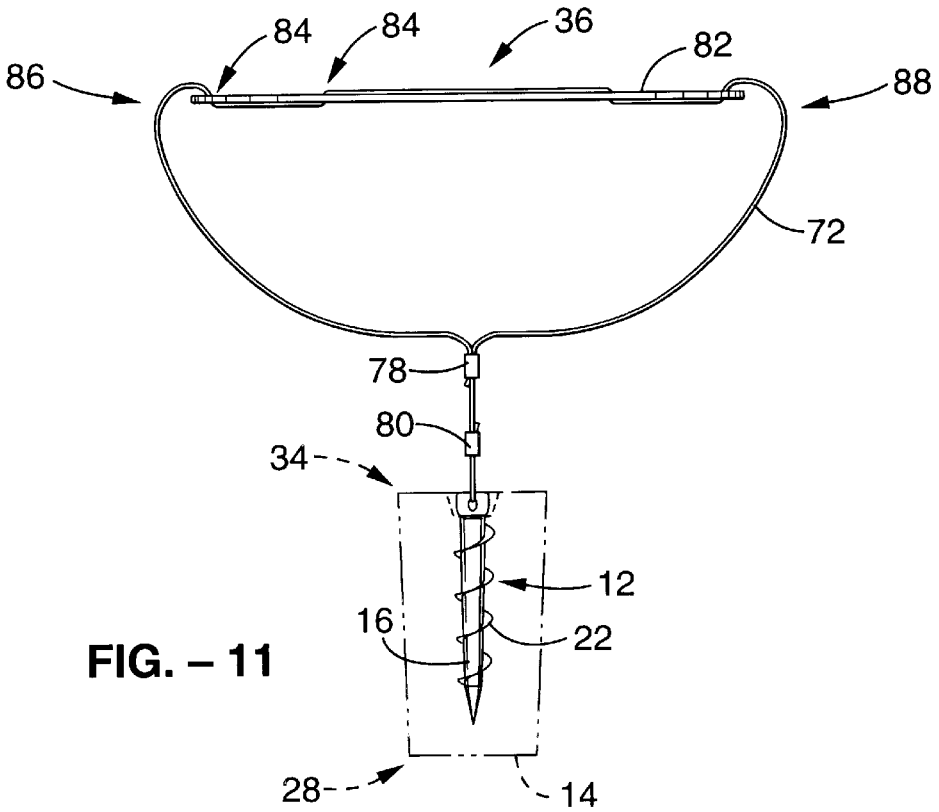
FIG. 11 is an elevation view of the cork removal apparatus of FIG. 10, in which a planar handle piece threaded by a cord, is used in place of the handle and stem of FIG. 10.
Figure 12:
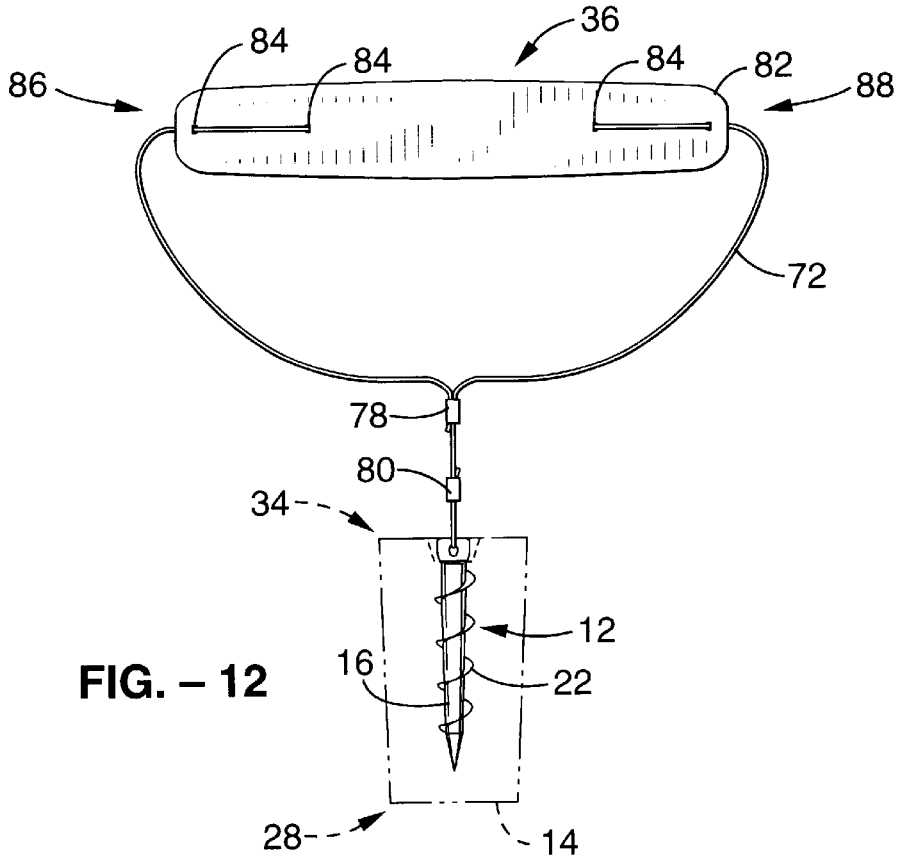
FIG. 12 is an elevation view of the cork removal apparatus of FIG. 11, with the planar handle section rotated for a facing view.

Referring now to FIG. 11 and FIG. 12, an alternative embodiment of the cork-pulling handle 36 is shown. In this embodiment, cork-pulling handle 36 comprises an elongated generally flat handle 82 having a plurality of openings 84 along the central longitudinal axis of handle 82 through which a flexible cord 72 is threaded so that it emerges from ends 86, 88 as shown. The handle 82 is rotated in FIG. 12 to better see the shape used in this embodiment of the handle. Note that in this embodiment the handle 82 easily rotates and fits comfortably in the user's hand.

With regard to production and assembly, the cork anchor is screwed into the cork, either directly or by threading it into an optional pilot hole drilled in the cork. The normal corking process, which involves compressing the cork, then secures the anchor in the cork. Alternatively, the anchor can be screwed into the cork once it has been pressed into the bottle during the corking process, since the cork does not need to have a pilot hole for the anchor to be properly inserted. Then either during, prior to, or possibly after applying the wrapper to the neck of the bottle, the cork-pulling handle is attached to the bottle for storage. In the embodiments where a cord or the like is used to couple anchor 12 and cork-pulling handle 36, the intermediate operation of connecting the cord to the anchor and cork-pulling handle would be required.

The anchor and cork-pulling handle can be constructed from metal, or preferably from a medium-hard polyester resin, such as polyethylene or similar material that can be used in an injection mold. Alternatively, the handle portion can be made from softer more flexible material if desired. This material need withstand only one use, unlike a conventional auxiliary cork screw. The cord can be fishing line, cord material, cable, chains or other flexible material that has a tensile strength rating of approximately 40.0 kg.

Figure 13:
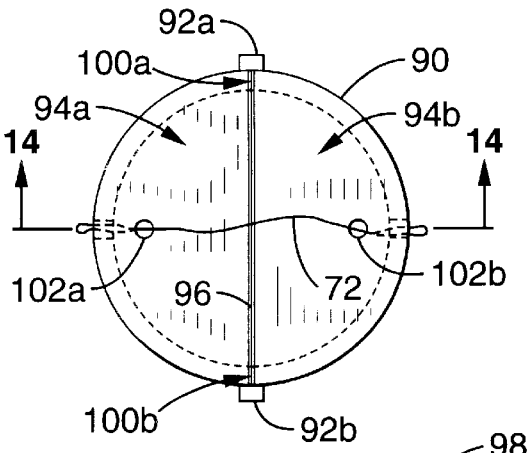
FIG. 13 is a plan view of a cork removal apparatus according to the invention in which a cork pulling handle is integrated with the bottle neck wrapper.
Figure 14:
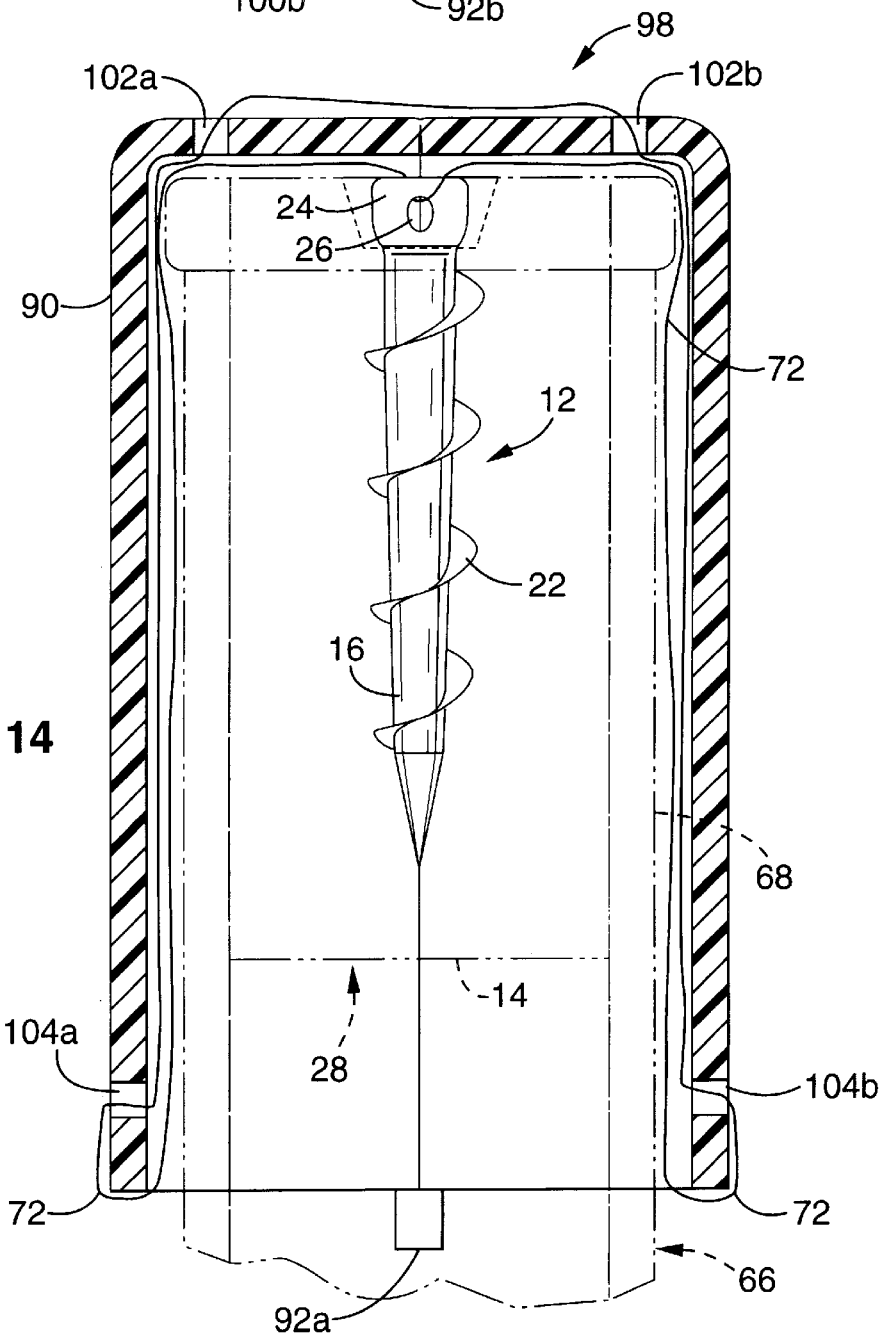
FIG. 14 is an elevation view of the cork removal apparatus of FIG. 13 in partial cross-section, in which a cork pulling handle is integrated with the bottle neck wrapper.
Figure 15:
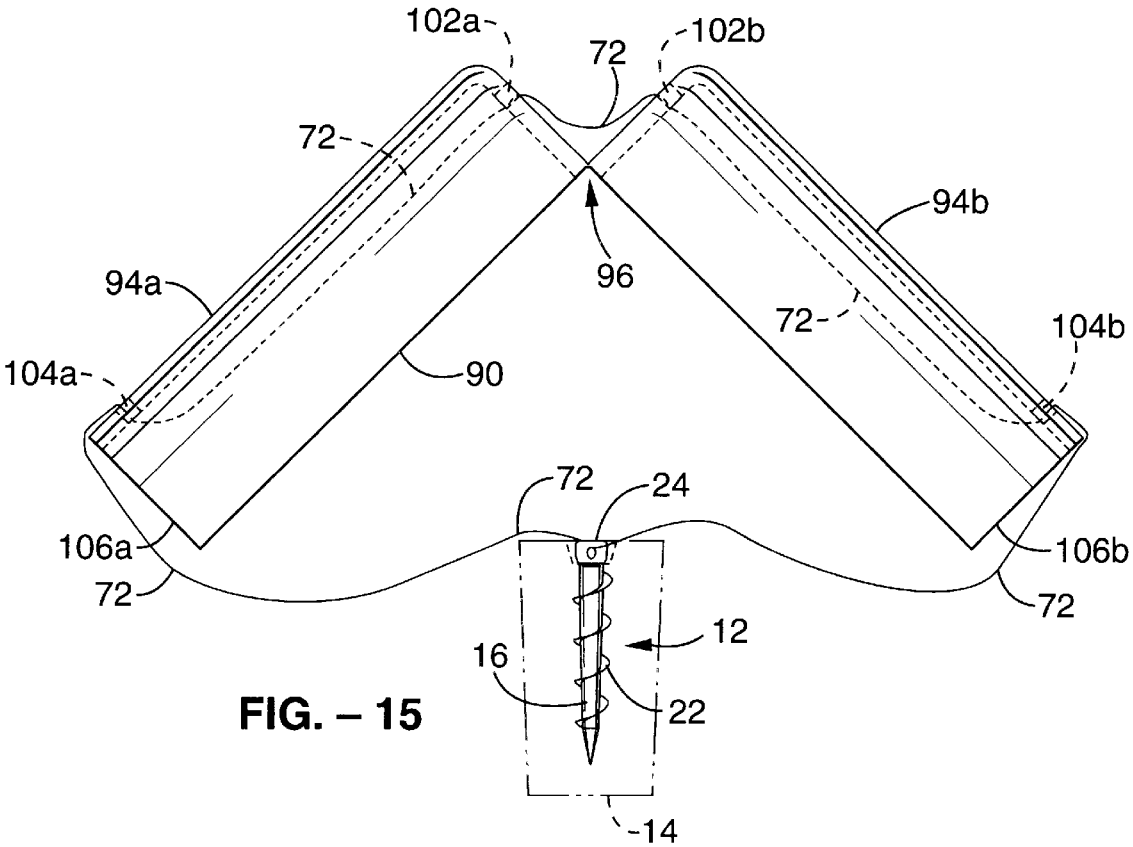
FIG. 15 is an elevation view of the cork removal apparatus shown in FIG. 13 and FIG. 14 with the combination bottle neck wrapper and handle partially open.
Figure 16:
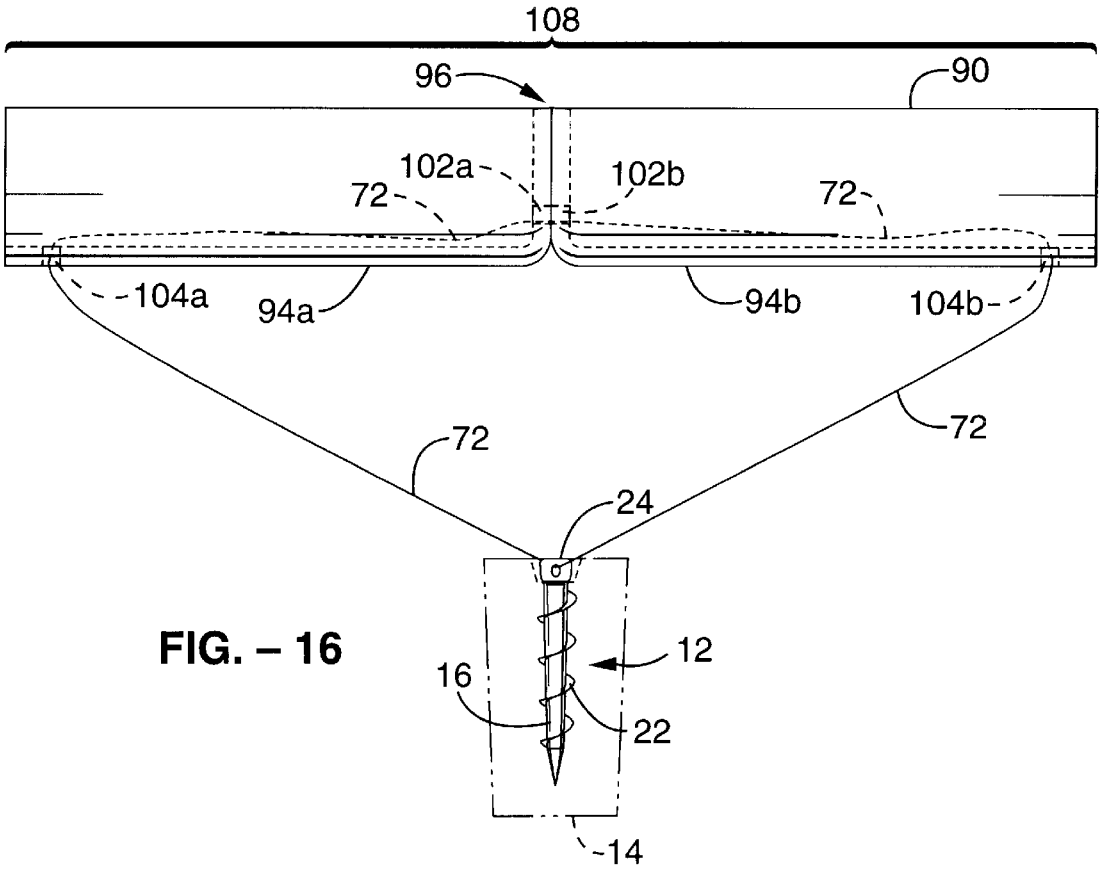
FIG. 16 is a front view of the cork removal apparatus of FIG. 13 and FIG. 14 shown with combination bottle neck wrapper fully deployed into a handle.

A cork pulling handle can also be integrated with the bottle top wrapper by the creation of a wrapper capsule 90 as depicted in FIG. 13 through FIG. 16. The cork-pulling handle 36 is integrated with the capsule style wrapper 90 that covers the top part of neck 68 of bottle 66, so that the wrapper itself, designed with adequate stiffness and gripping length, becomes the pulling handle. Here, wrapper 90 includes two rip tabs 92*a*, 92*b* that are co-linear with the bottle axis, separated from each other by approximately 180 degrees, and run the length of wrapper 90 as shown in FIG. 14. When tabs 92*a*, 92*b* are pulled, wrapper 90 is split into the two sections 94*a*, 94*b* as shown in FIG. 15. The two sections can be folded open and rotated into a handle 108 that is perpendicular to the axis of the bottle and twice the length of the original capsule wrapper 90 of FIG. 14. By using a folding crease 96 across the disk-shaped top 98 of wrapper 90 extending between the two upper ends 100*a*, 100*b* of the two rip-tab paths as shown in FIG. 13, the opening operation is facilitated. By threading cord 58 through openings 102*a*, 102*b* in sections 94*a*, 94*b*, respectively, in the top 98 of wrapper 90 (FIG. 13), as well as through openings 104*a*, 104*b* in the bottom ends 106*a*, 106*b* of sections 94*a* and 94*b* respectively, of wrapper 90 (FIG. 14), and threading it through eye 24 in anchor 12 in the manner shown in FIG. 15 and FIG. 16, the handle will naturally rotate 180° as one prepares to pull the cord, and the handle will fit comfortably in the user's hand and operate similar to handle 82 shown in FIG. 11 and FIG. 12.

Another alternative is to integrate the bottle-neck wrapper with cork-pulling handle as described above, without requiring that a connection operation be performed by the consumer. Here, the connection between anchor 12 in cork 14 and cork-pulling handle 36 would be directly made when the capsule style handle/wrapper combination is applied to the bottle during production. For example, from the operational position, the handle can be foldable in one direction, so that it can be wrapped over the top of the bottle, but not foldable in the opposite direction so that, in the operational position, the handle is stiff enough to enable the user to execute the necessary pull using a three- or four-finger grip.

With regard to production and assembly, the cork and anchor assembly can be produced as earlier described, while the capsule wrapper with strap in connection with the anchor may be added to the bottle at any time after the bottle has been corked. The capsule wrapper which forms the handle may be made from a variety of materials including polyester resins, such as polyethylene or similar material that can be used in an injection mold.

Three additional alternate embodiments are now described and depicted in FIG. 17 through FIG. 37, which employ the raised flat-top cork anchor style that was described previously and shown in FIG. 7 and FIG. 8.

Figure 17:
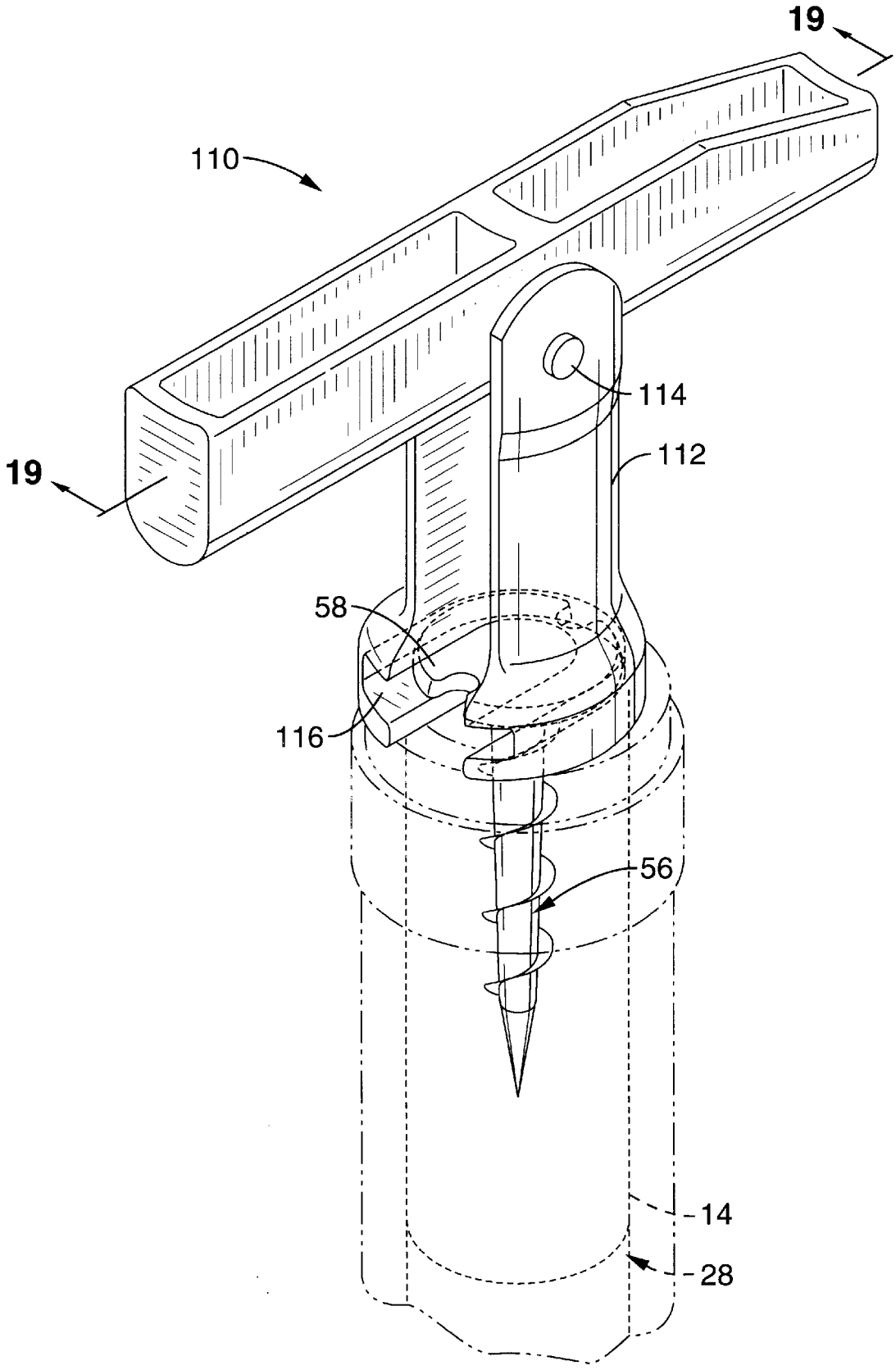
FIG. 17 is a perspective assembled view of a cork removal apparatus according to the invention in which a contoured handle assembly and pulling stem are pivotally attached and connected by means of a slot to a raised flat top cork anchor, and further shown placed on a bottle depicted in phantom.
Figure 18:
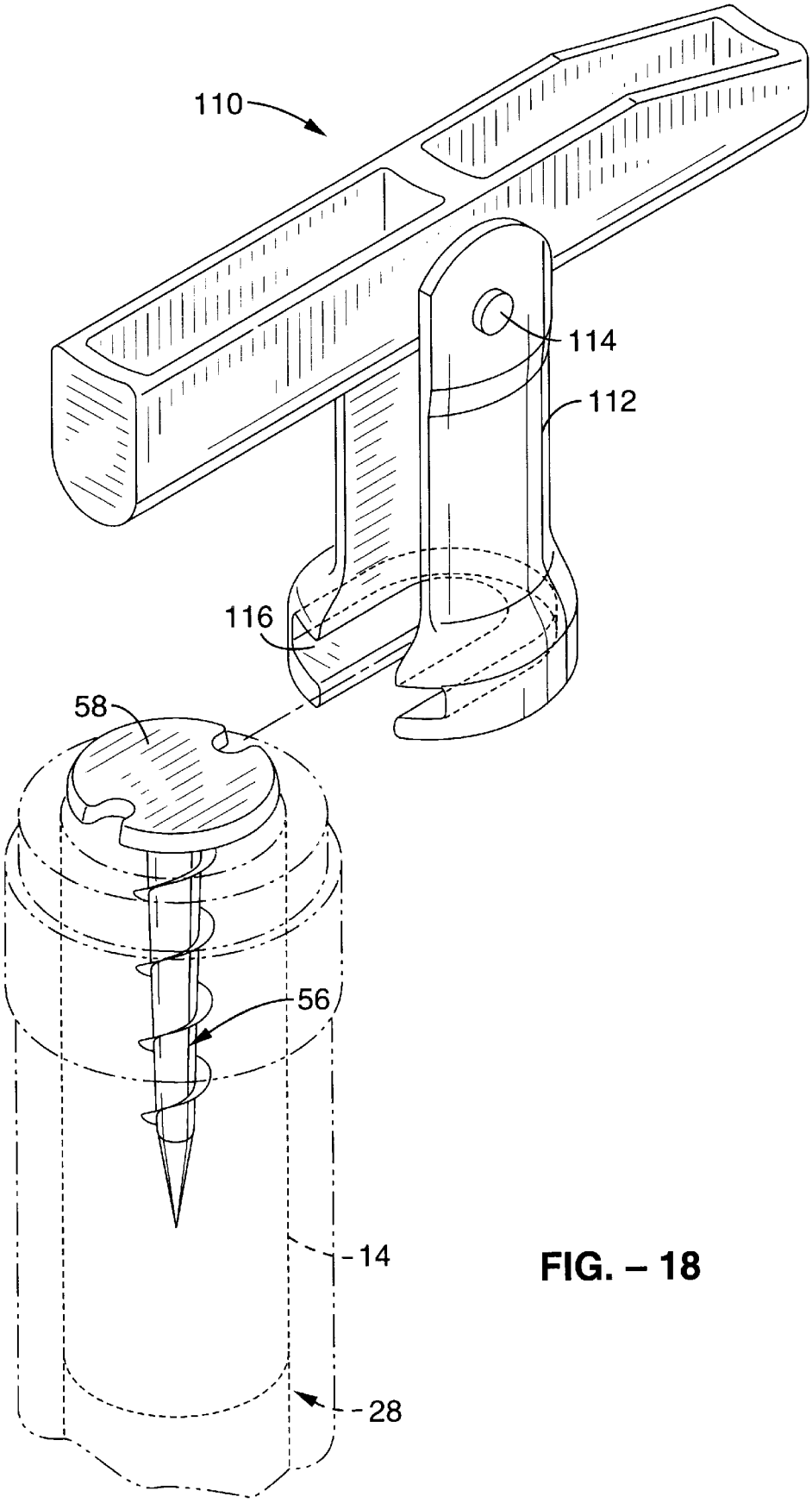
FIG. 18 is a perspective exploded view of the cork removal apparatus of FIG. 17, with the cork/anchor assembly shown inserted into a bottle depicted in phantom.
Figure 19:
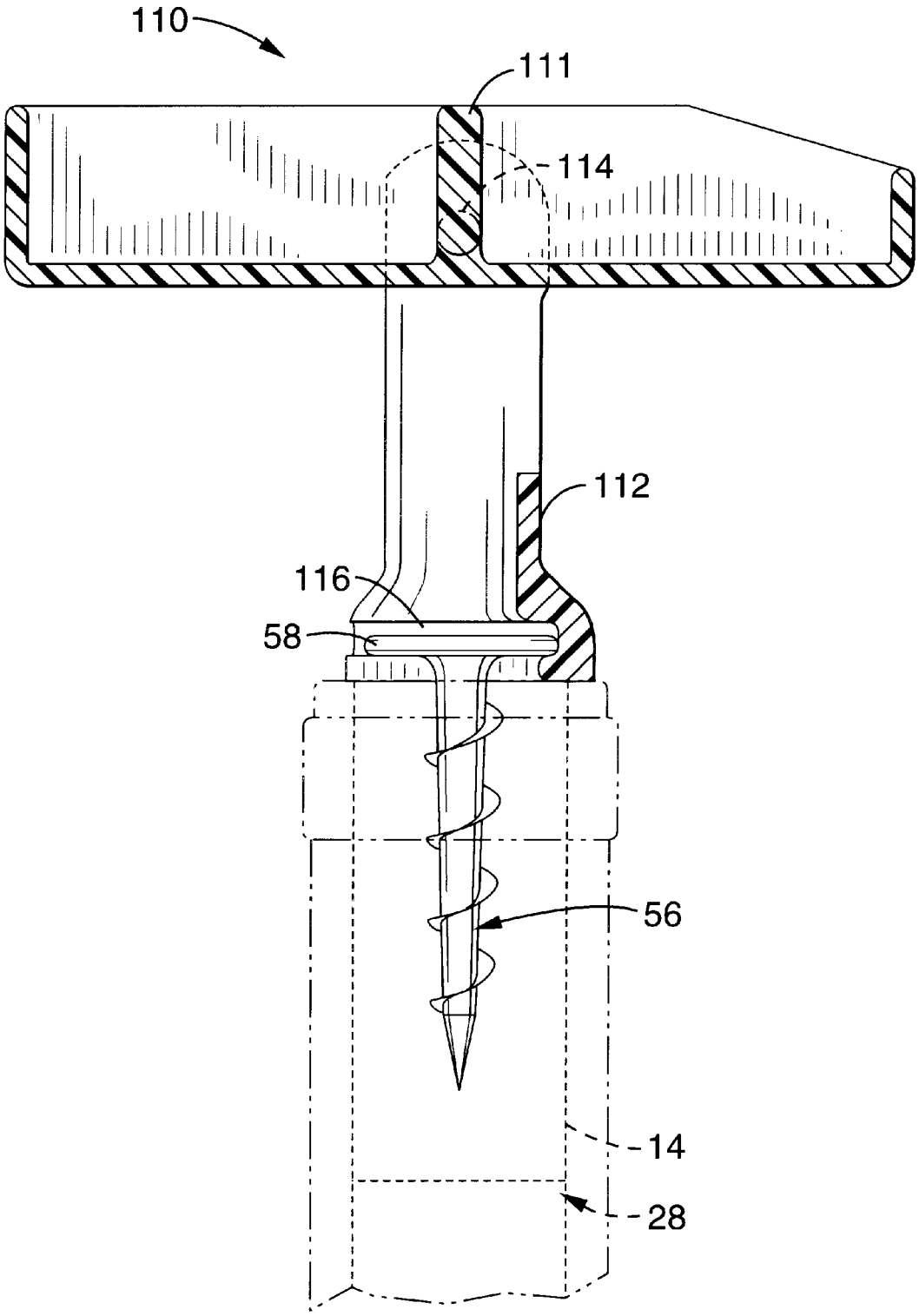
FIG. 19 is an elevation view of the cork removal apparatus of FIG. 17 and FIG. 18 with the handle portion shown in partial cross-section.
Figure 20:
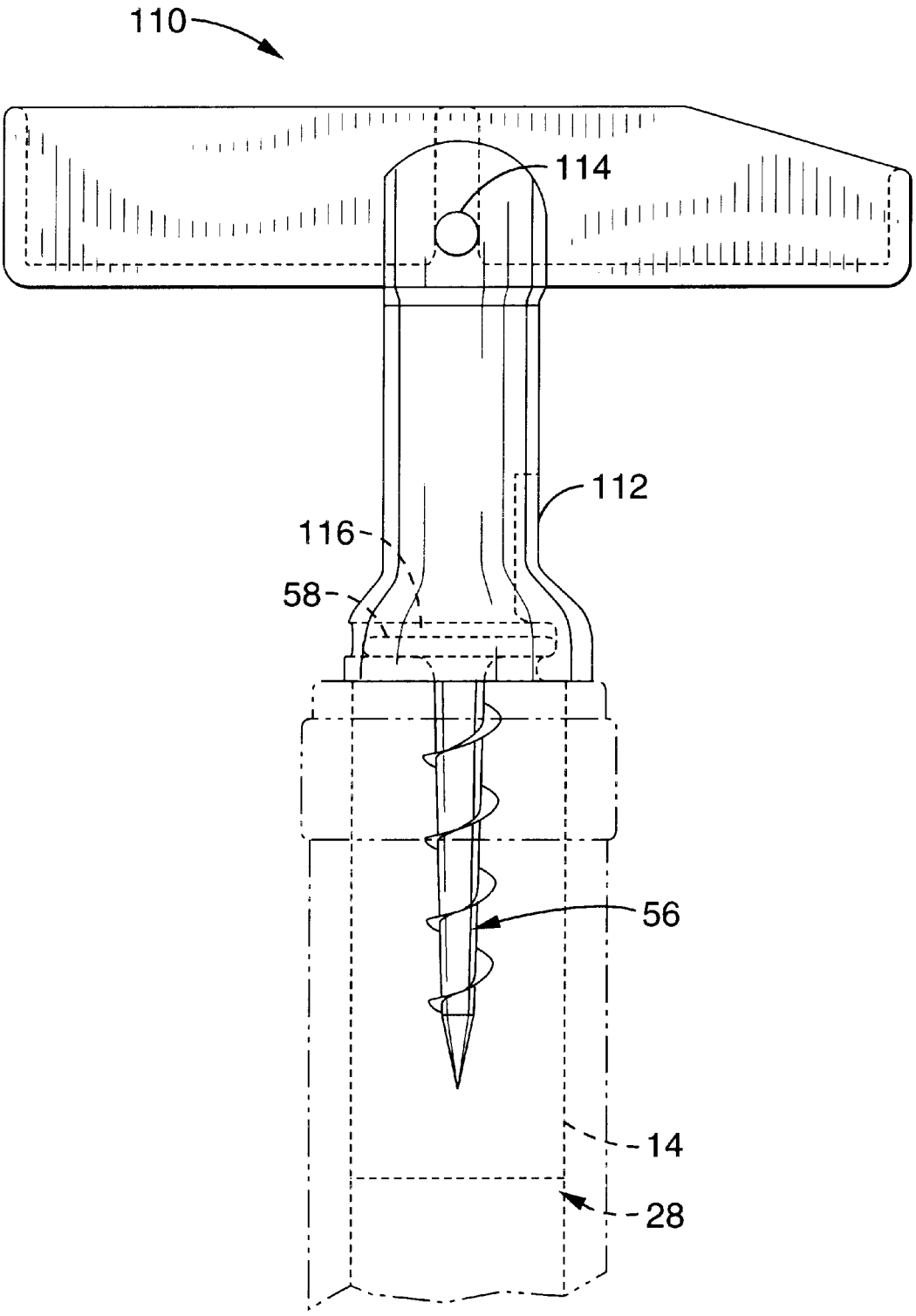
FIG. 20 is an elevation view of the cork removal apparatus of FIG. 17.

FIG. 17 shows an embodiment of the cork removal apparatus wherein a contoured handle assembly and pulling stem are pivotally attached and shown connecting to a raised flat-top anchor by means of a slot in the stem. Handle 110 is pivotally connected to a stem 112. The lower end of the stem 112 contains a slot 116 that is used for engaging the head 58 of the cork anchor 56 so that upon pulling the handle the cork will be extracted. The pivoting handle allows the person extracting the cork to rotate the handle for better comfort while it allows the handle to be folded upon itself for storage. This handle assembly is shown again in FIG. 18 disconnected from the head 58 of the cork anchor 56. The slot 116 within the stem 112 can be more easily seen in this view. The handle 110 has two circular bosses 114 extending out on each side, over which the corresponding holes (not shown) on the stem section 112 are slid to form the pivot. Referring also to FIG. 19 the handle 110 is shown as a single piece unit with a web 111 across the center to reinforce the pivot area. The cross section of the stem 112 shows that a large portion of the area between the front and back of the stem are left open to allow room for the handle 110 to pivot down into the stem 112 for storage. Both sides of the slot 116 are shown in FIG. 17 as engaged on the head 58 of the anchor 56, wherein it will be noted that in FIG. 19, the center section of the stem, shown as cross hatched in this figure, also is engaged with the head 58 of the cork anchor 56. FIG. 20 shows a front view of the handle 110 with stem 112 attached at a pivot 114 connected to the cork anchor 56.

Figure 21:
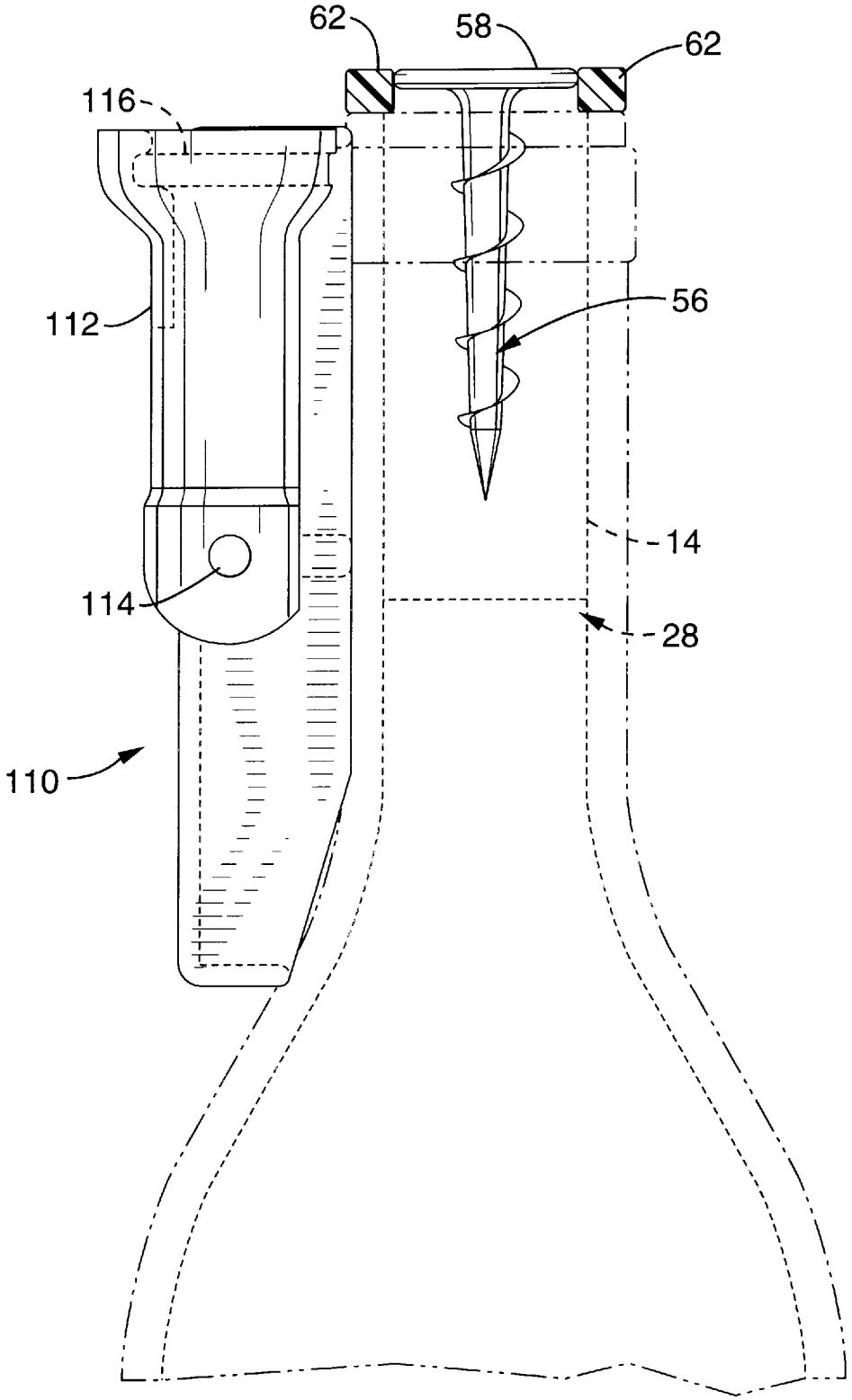
FIG. 21 is an elevation view of the cork removal apparatus of FIG. 17, shown folded and stored alongside the neck of a bottle depicted in phantom, with the packaging ring shown in cross-section.

Referring to FIG. 21, the pivoting handle can be folded and stored along the side of the bottle. The labels and wrappers that would generally cover the neck of the bottle and attach the handle to the side of the bottle are not shown. The head 58 of anchor 56 is shown with an encircling packaging ring 62. The packaging ring 62 serves twin functions; it provides a safety seal, while it additionally creates a flush transition between the bottle and the anchor head 58 that enhances aesthetics when used by itself, or when used under a wrapping material. As can be seen, the handle 110 has been folded into the stem 112 by rotating it through the pivot 114, thus forming a co-linear assembly that simplifies storage. The bulk of the folded pulling handle is stored against the neck of the bottle 68 with the lower section positioned against the shoulder of the bottle 64 to prevent the handle from slipping downward in the finished package.

Figure 22:
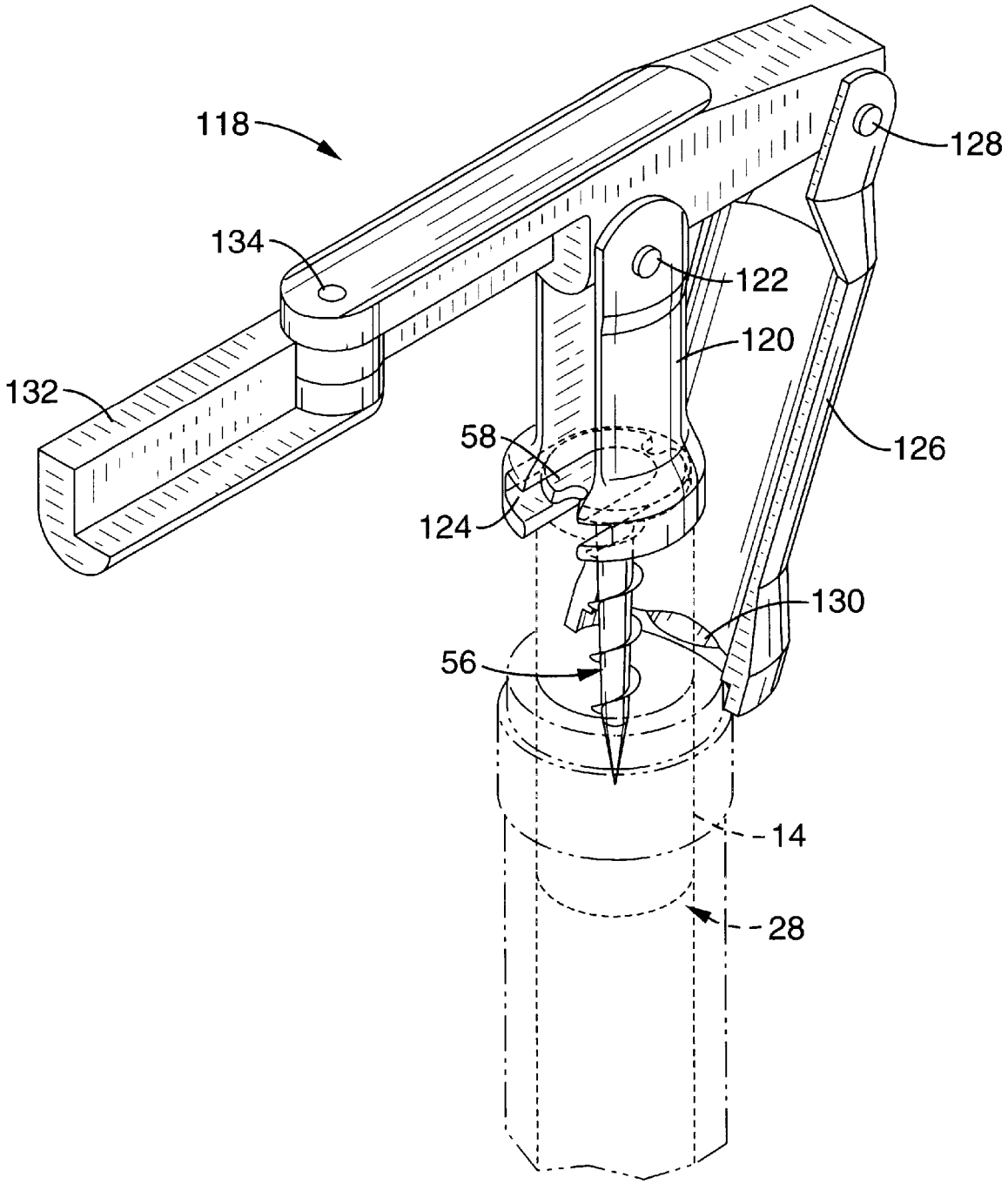
FIG. 22 is a perspective assembled view of a cork removal apparatus in which a extendable contoured handle and a pulling stem are pivotally attached and connected to a raised flat top cork anchor wherein an additional lever assembly is coupled to the opposite end of the handle to decrease the required pulling force, shown attached to a bottle depicted in phantom.
Figure 23:
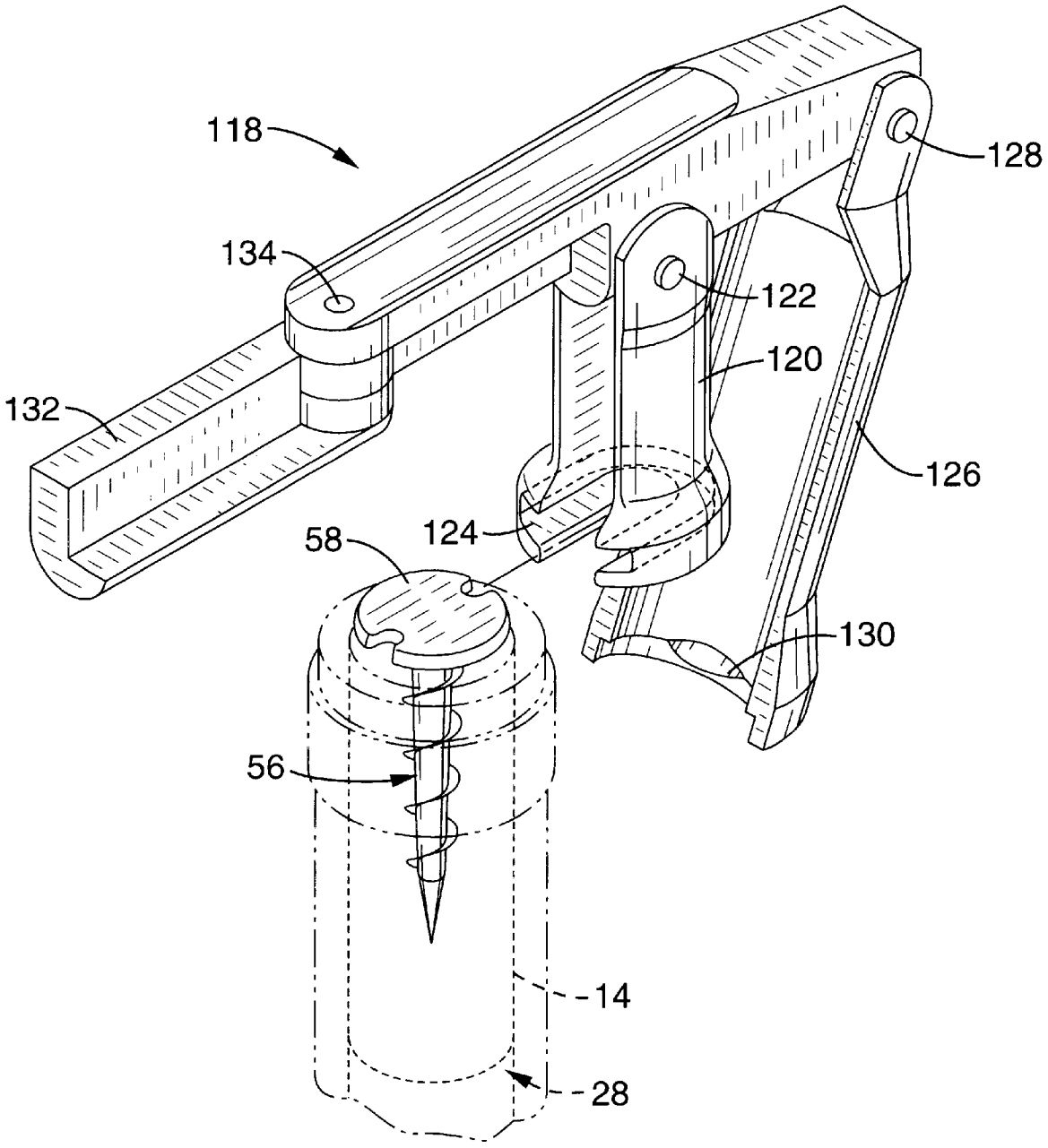
FIG. 23 is a perspective exploded view of the cork removal apparatus of FIG. 22, with the cork/anchor assembly inserted in a bottle depicted in phantom.
Figure 24A:
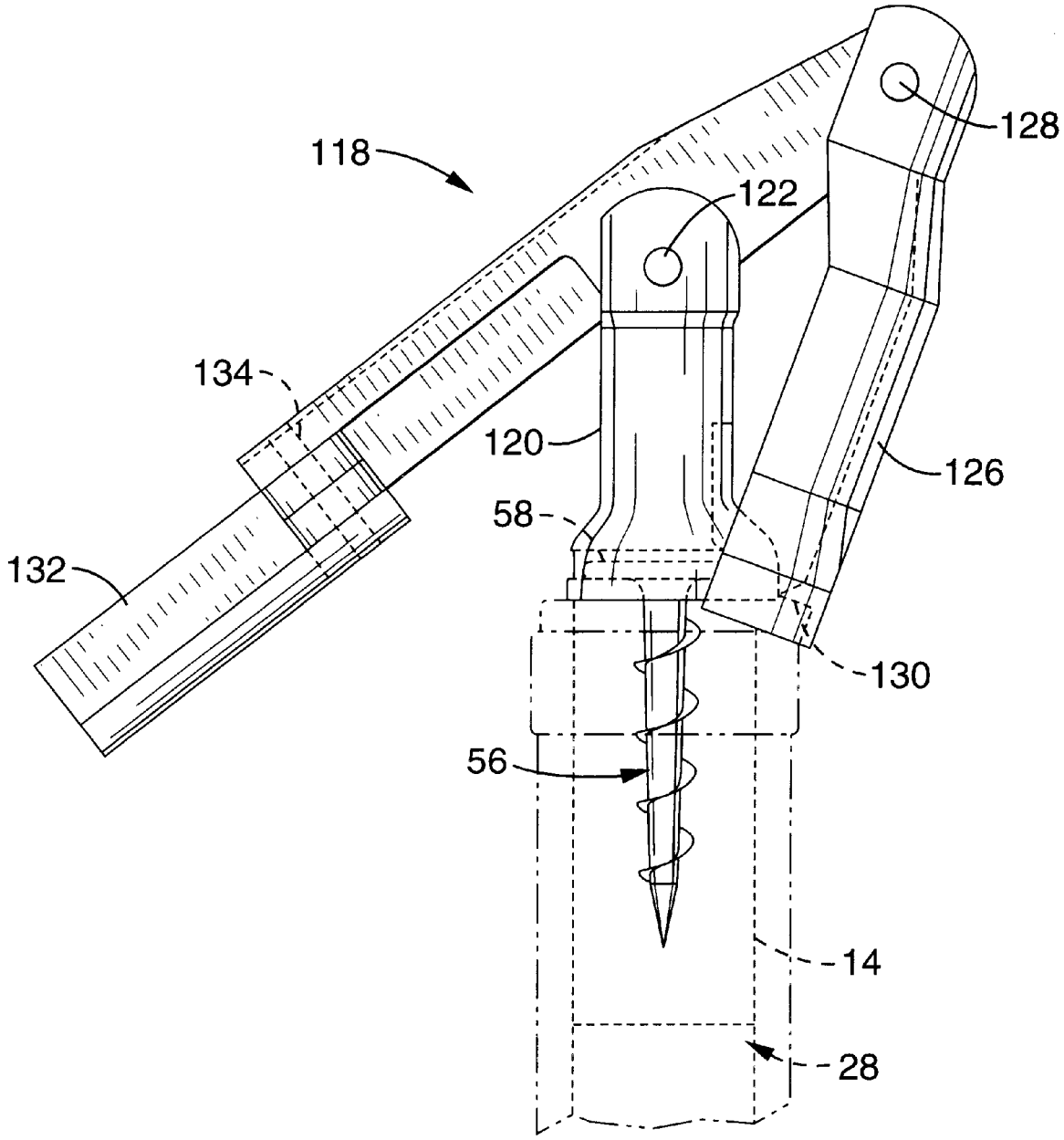
FIG. 24A is an elevation view the cork removal apparatus of FIG. 22, shown fully engaged with the cork anchor but prior to commencement of extraction.
Figure 24B:
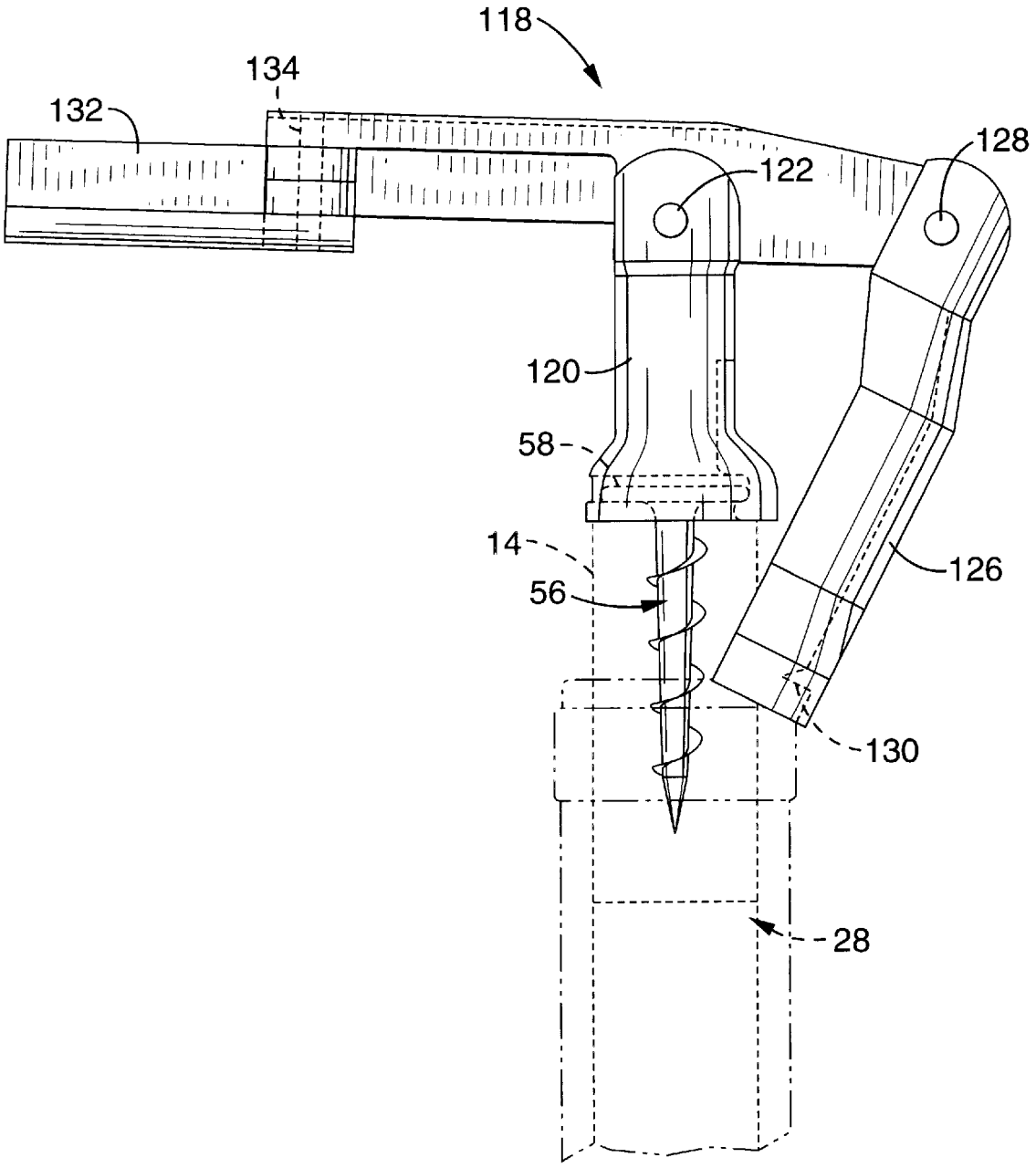
FIG. 24B is an elevation view the cork removal apparatus of FIG. 24A, shown fully engaged with the cork anchor and cork partially removed.
Figure 24C:
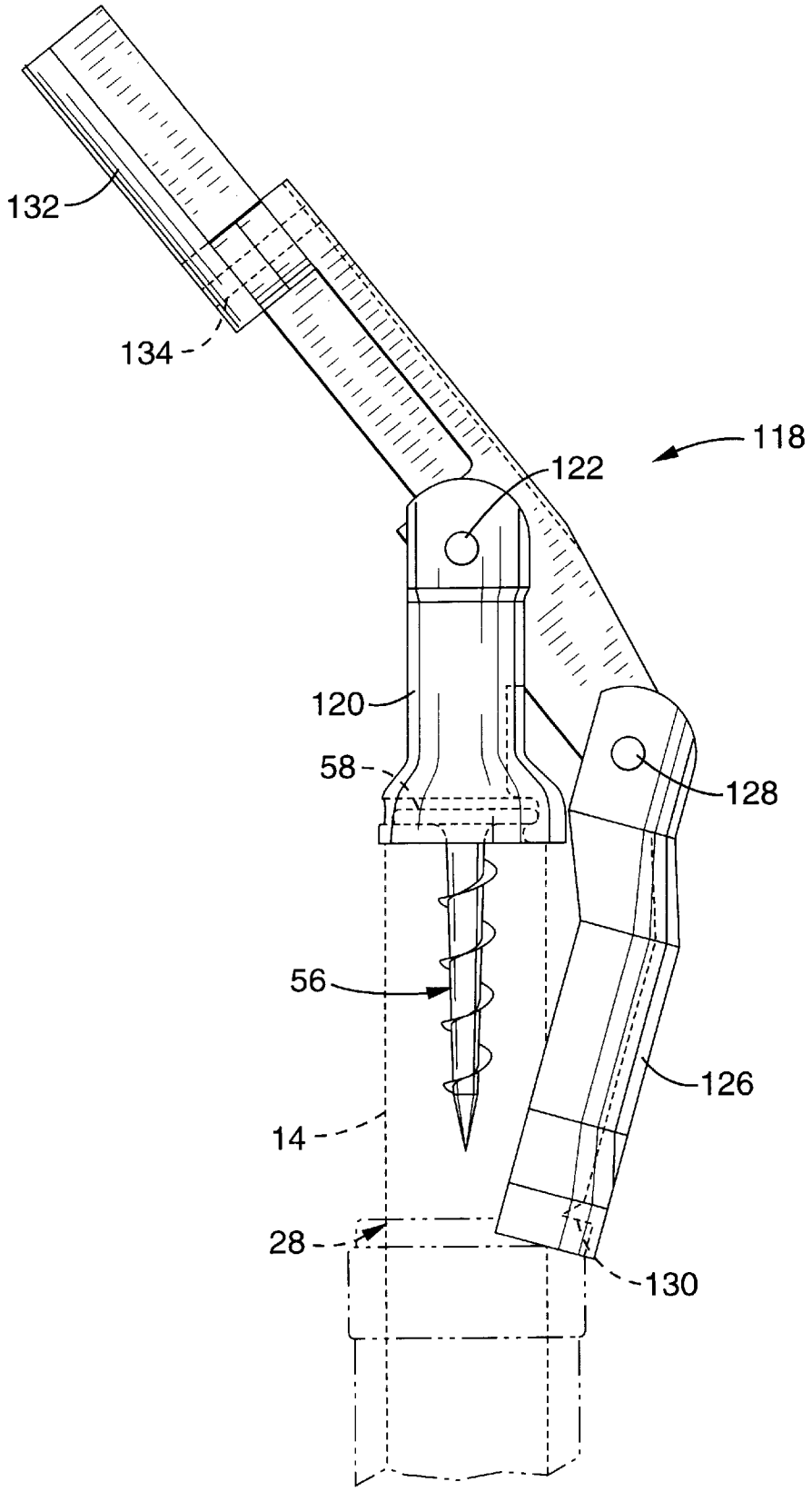
FIG. 24C is an elevation view the cork removal apparatus of FIG. 24A, shown fully engaged with the cork anchor and cork fully removed.
Figure 25:
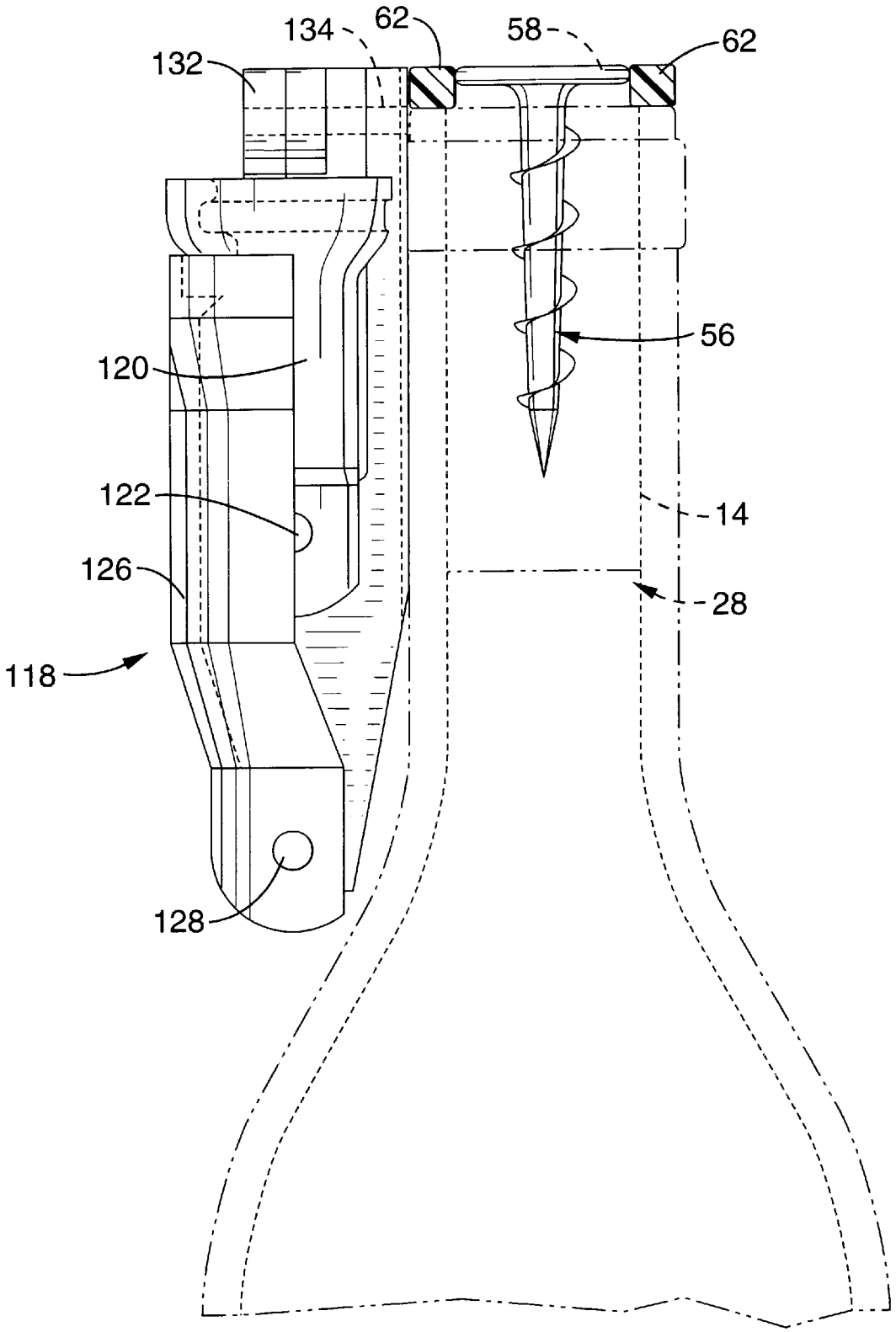
FIG. 25 is an elevation view of the cork removal apparatus of FIG. 22, shown folded and stored alongside the neck of a bottle depicted in phantom, with the packaging ring shown in cross section.
Figure 26:
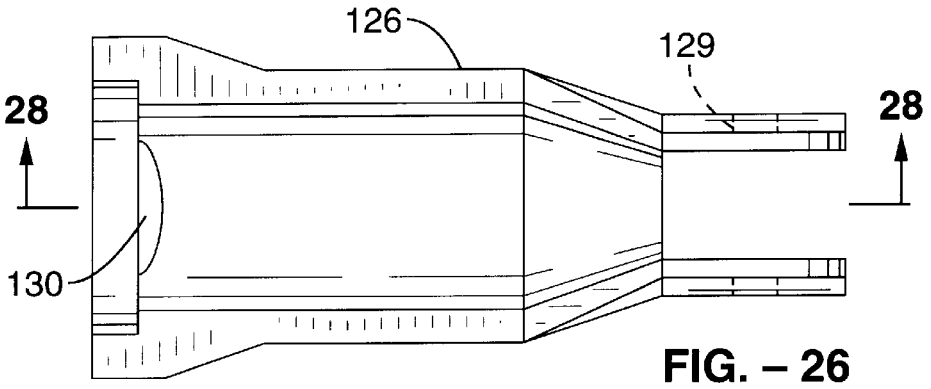
FIG. 26 is a side view of the lever arm used on the cork removal apparatus shown in FIG. 22.
Figure 27:
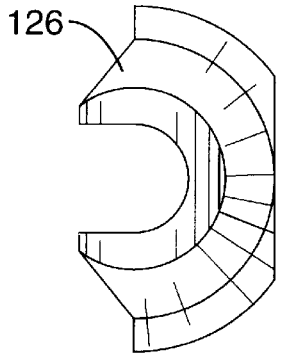
FIG. 27 is a plan view of the lever arm of FIG. 26.
Figure 28:
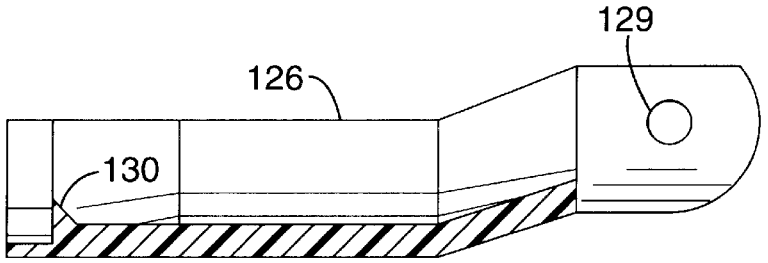
FIG. 28 is a cross-sectional front view of the lever arm of FIG. 26 taken through line 28—28.
Figure 29:
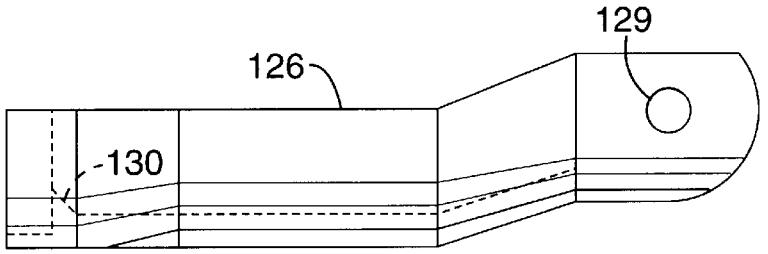
FIG. 29 is an elevation view of the lever arm shown in FIG. 26.
Figure 30:
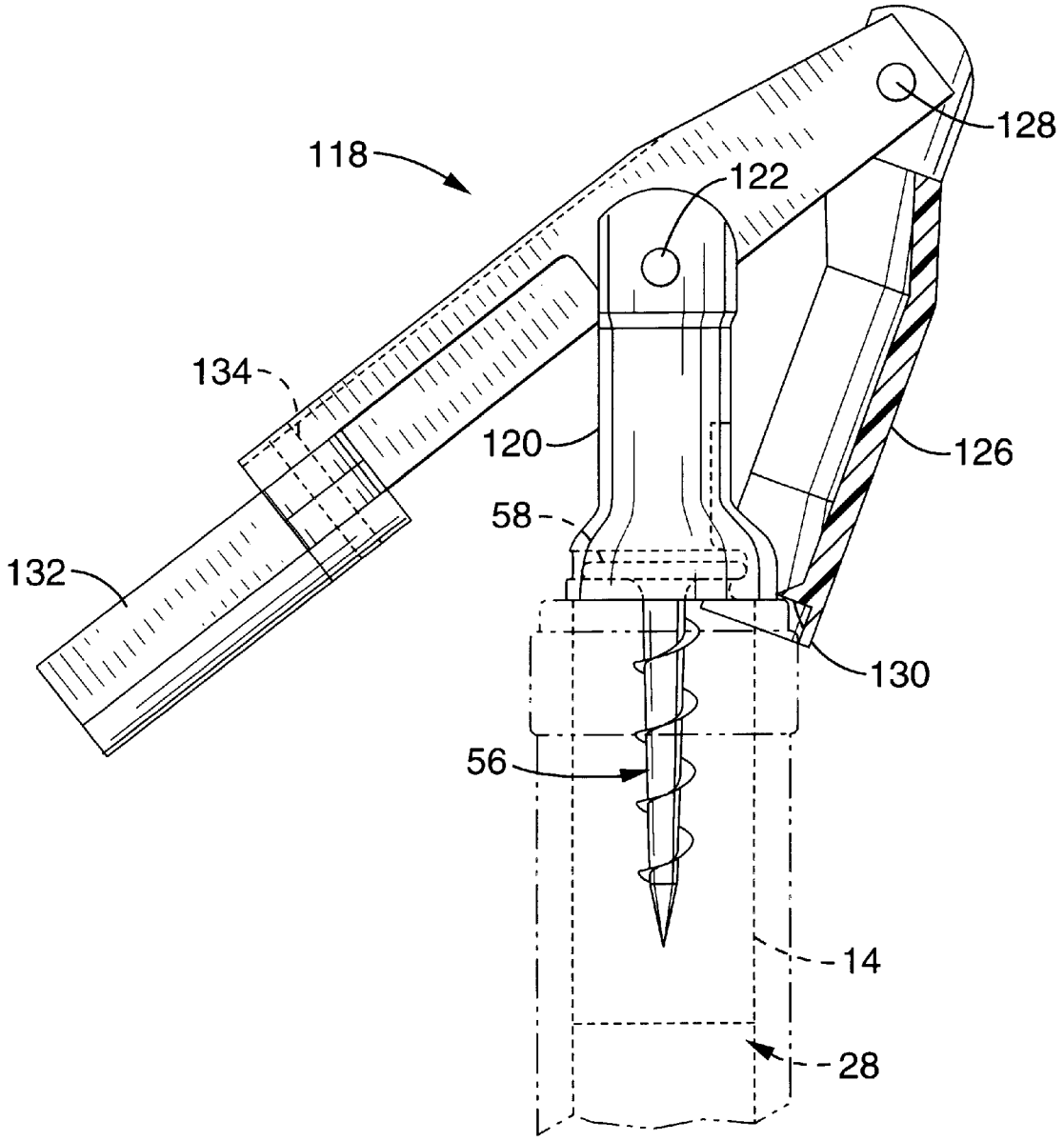
FIG. 30 is an assembled elevation view of the cork removal apparatus of FIG. 22 showing the lever arm in partial cross section.
Figure 31:
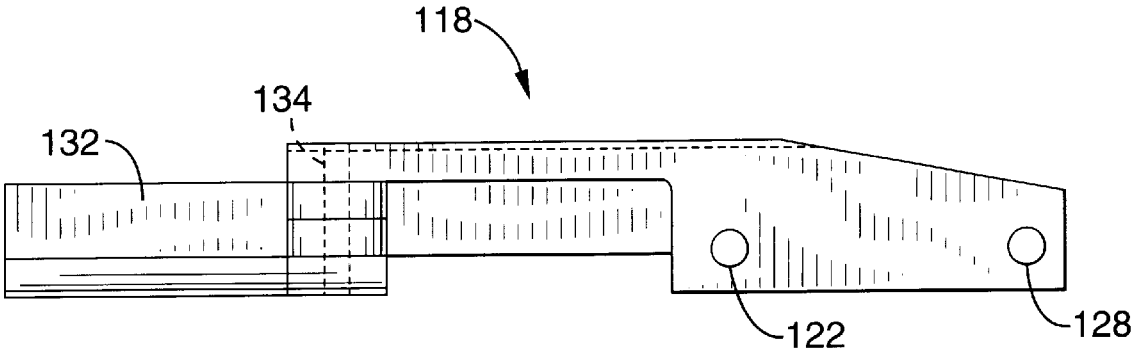
FIG. 31 is an elevation view of the handle portion of the cork removal apparatus of FIG. 22 shown with the handle extension fully extended.
Figure 32:
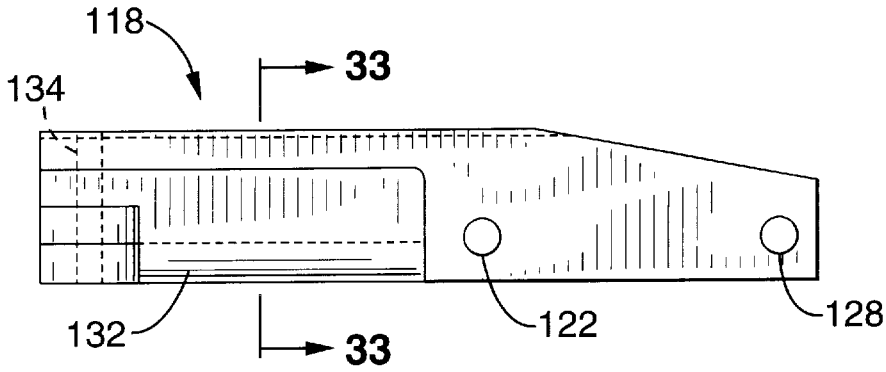
FIG. 32 is an elevation view of the handle portion of the cork removal apparatus of FIG. 22 shown with the handle extension retracted.
Figure 33:
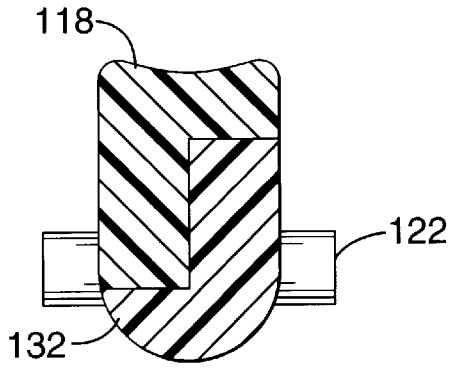
FIG. 33 is a cross section view of the handle assembly of FIG. 32 taken through 33—33.

An alternate embodiment of a levered cork removal apparatus is shown in FIG. 22, wherein a lever is used to reduce the amount of pulling force required to remove the cork. A contoured handle 118 is attached to a stem 120 by means of a pivot 122 as in the previously described embodiment. A lever 126 is connected to one end of the handle 118 by a pivot 128, while the other end of the lever 130 is placed against the top of the bottle to provide a fulcrum. As in the previous embodiment, the stem 120 is attached to the handle 118 by means of a pivot 122 and contains a slot 124 that engages the head 58 of the cork anchor 56. To remove the cork, the end of the handle 118 that is opposite of the lever arm is pulled, whereby the force produced acts through the fulcrum created by the bottle lip 130 of the lever arm 126 pressing against the bottle, so that a reduction in required pulling force is achieved. The handle 118 also contains a swing out extension 132 to allow for greater leverage and thereby to further reduce the pulling force required. The handle extension 132 is attached to the handle by means of a pivot 134. The figure depicts cork extraction in progress as the cork shown in phantom is seen partially removed from the bottle. This handle assembly is shown again in FIG. 23 disconnected from the head 58 of the cork anchor 56. The slot 124 and the bottle lip 130 of the lever are more easily seen in this exploded view (FIG. 23) than in the previous figure. To better understand the process of cork extraction as it relates to this embodiment, FIG. 24A through FIG. 24C show the apparatus at three stages of the cork extraction process. In FIG. 24A the cork puller has been unfolded and attached to the cork anchor on top of the bottle, cork extraction is ready to commence. With the application of upward force to the handle 132, the cork begins to pull out. FIG. 24B depicts the cork approximately half-way removed. Continued application of force on the handle 132 results in the full extraction of the cork as depicted in FIG. 24C, at which time the cork puller is separated from the bottle and the fully intact cork with anchor can be removed from the cork puller to be either saved or discarded. Referring to FIG. 25, the handle extension can be retracted and the pivoting handle and lever arms folded to allow the cork pulling apparatus to be stored along the side of the bottle. Again, the figure does not show the labels and wrappers that would generally cover the neck of the bottle and attach the handle to the side of the bottle. A packaging ring 62 as previously described provides a safety seal and allows for the creation of a more aesthetic package. The lever arm by itself is shown in FIG. 26 through FIG. 29. In FIG. 26, a side plan view of the lever arm 126 is shown with the pivot point lying to the right and the bottle catch lip on the left. The hidden lines of the stem show the holes 129 through which the bosses from the handle section 118 are inserted. The view depicted in FIG. 27 is looking up from underneath of the lever arm 126, wherein the circular section that mates with the top of the bottle can be seen. And a hidden line representation of the same piece in the same orientation is shown in FIG. 29. FIG. 30, shows the unit assembled and ready for pulling the cork. The bottle catch lip 130 of the lever arm 126 is easily seen in this view pressing against the lip of the bottle. The extendable handle 118 is shown in FIG. 31 through FIG. 33. The handle 118 with extension 132 swung out on pivot 134 to its full extension is shown in the front view of FIG. 31. Bosses protrude on each side of the handle 118 at locations marked by the pivot points 122, 128. A hidden line on top of the handle shows a concave section of the handle that fits against the neck of the bottle for storage. The extendable handle has a radiused lower section the full width of handle 118 to provide a wide smooth hand-grip for pulling. When collapsed, this lower part of the handle stows underneath the handle 118 which can be seen in FIG. 32. A sectional view of the manner in which the handle extension 132 fits underneath the body of the handle 118 is shown in FIG. 33. The underside of the handle 132 is a semicircular section that has been slid under the body of the handle 118. Also to be noted are the protruding bosses that provide the pivots 122 on either side of the handle 118, and the concave indentation in the top of the handle to fit the neck of the bottle.

Figure 34:
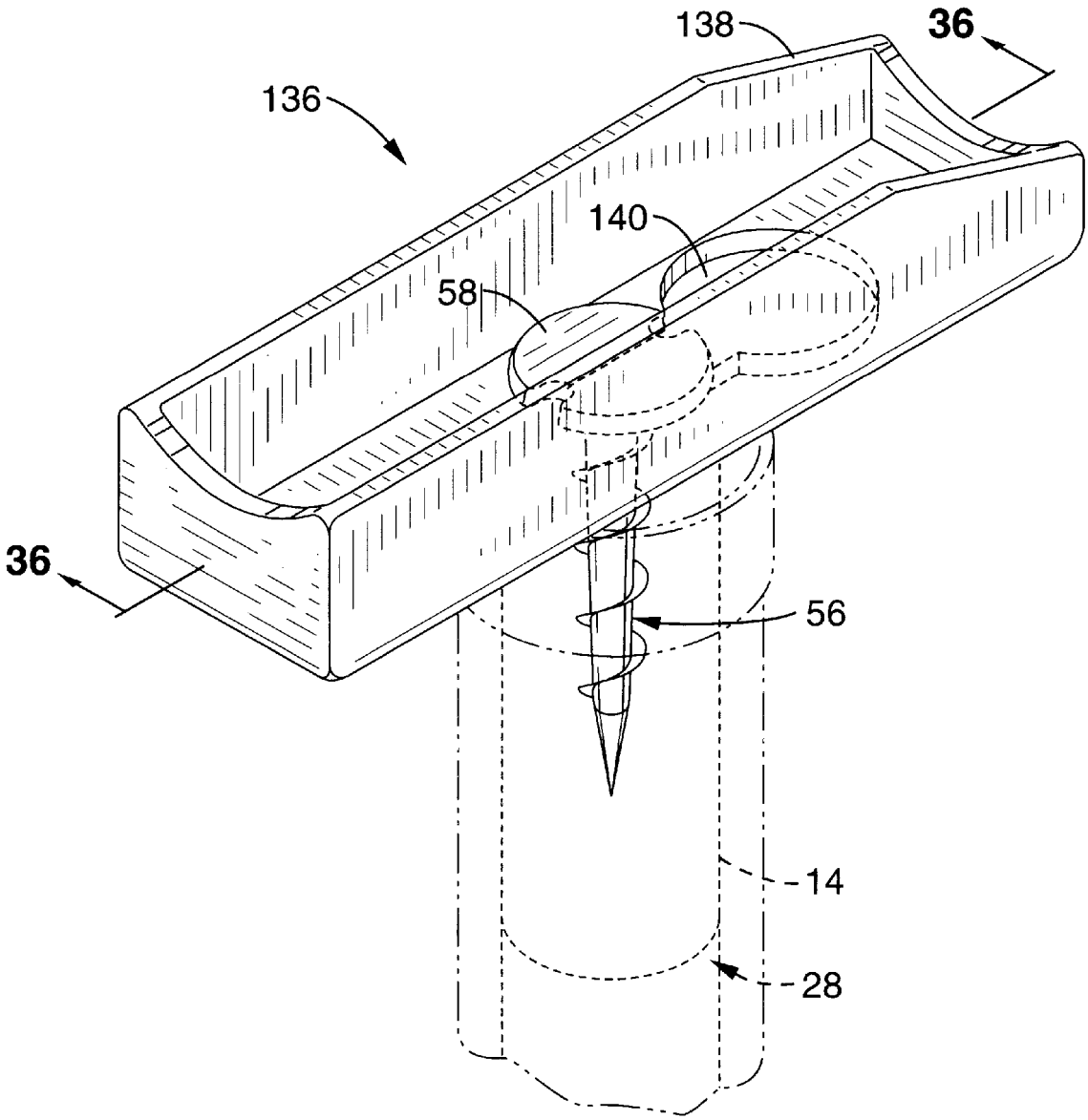
FIG. 34 is a perspective assembled view of a cork removal apparatus according to the invention in which a one-piece slotted handle assembly is attached to the cork anchor.
Figure 35:
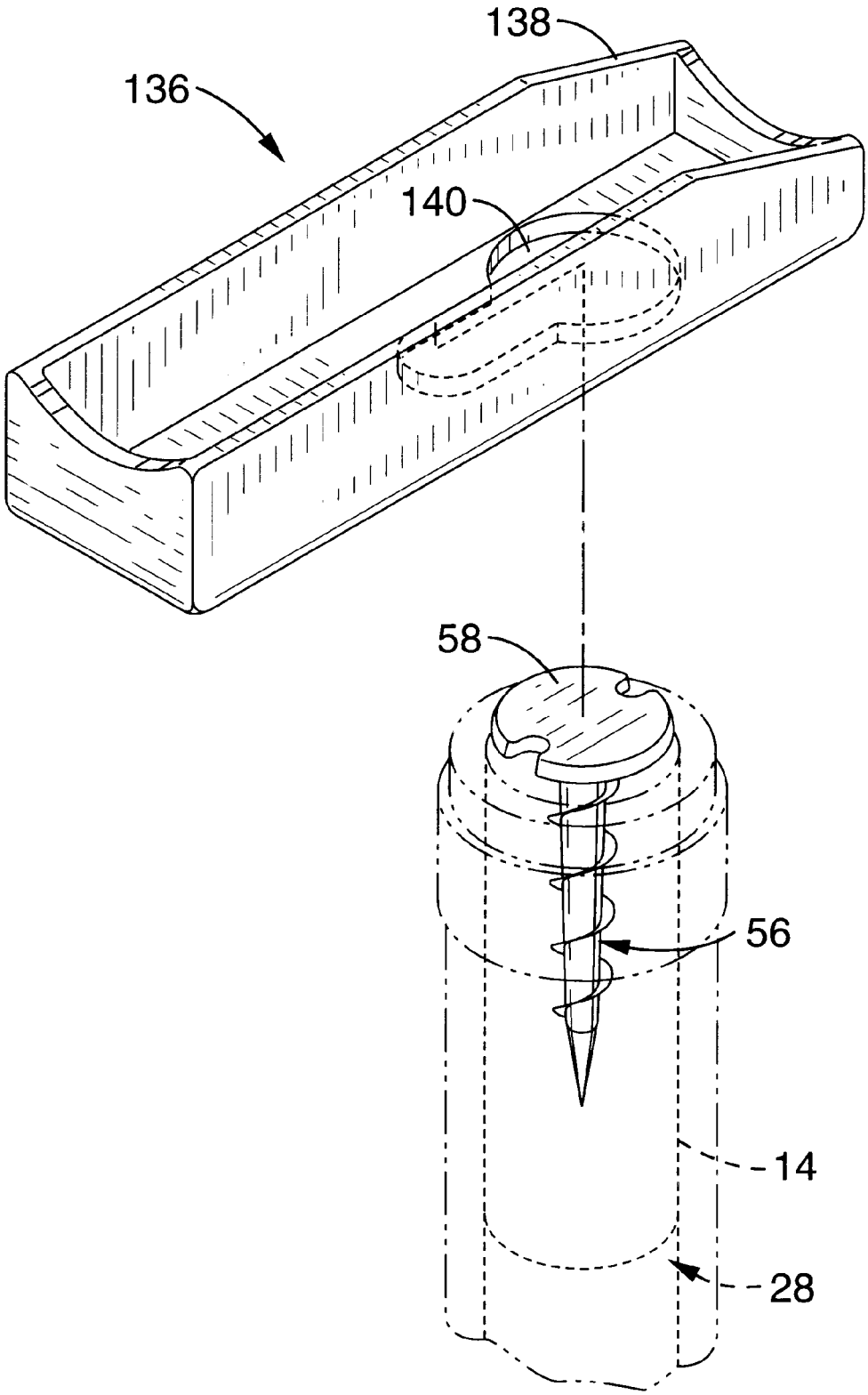
FIG. 35 is an exploded perspective view of the cork removal apparatus shown in FIG. 34.
Figure 36:
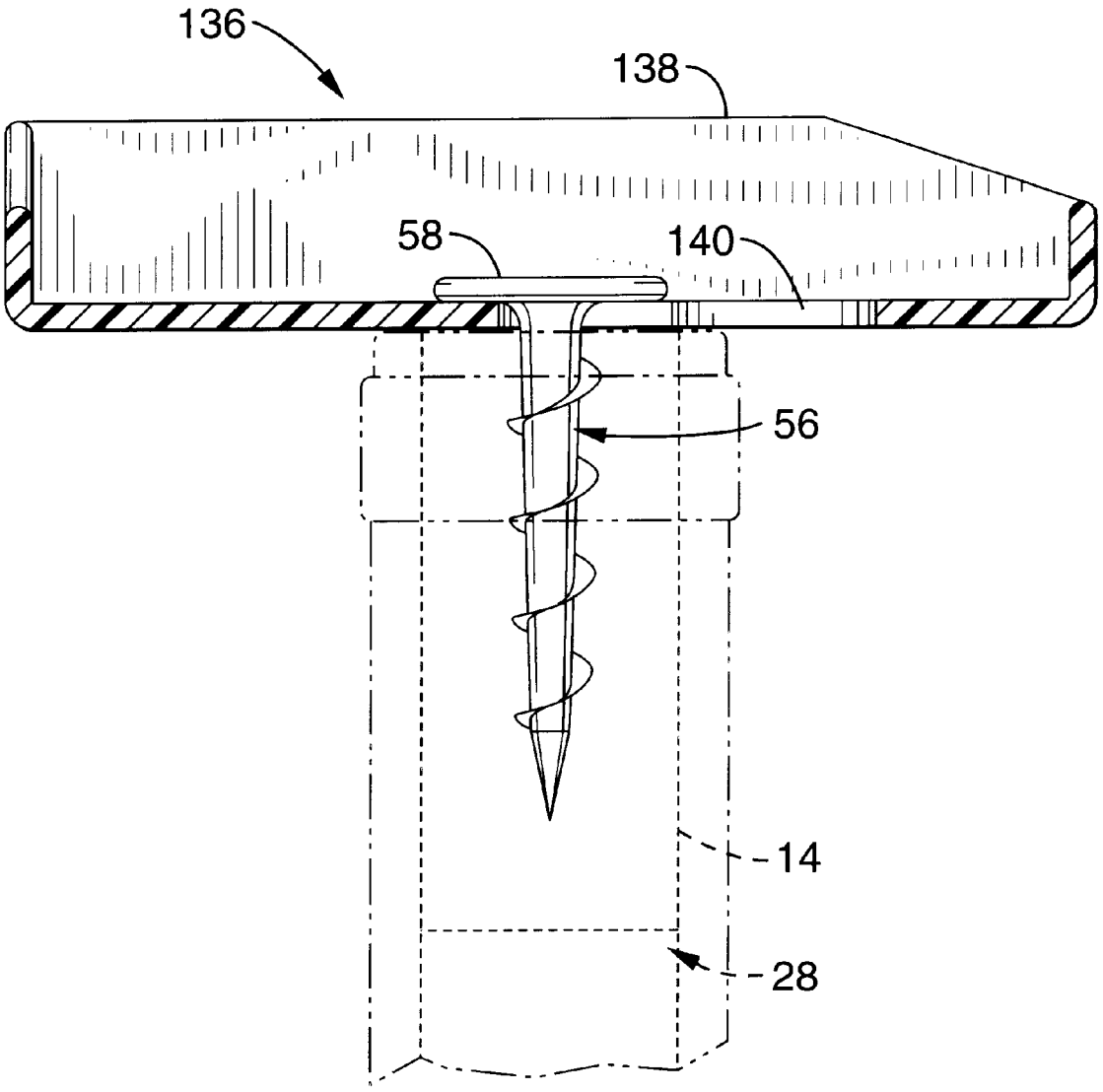
FIG. 36 is an elevation view in partial cross-section of the handle shown in FIG. 34 taken through line 36—36.
Figure 37:
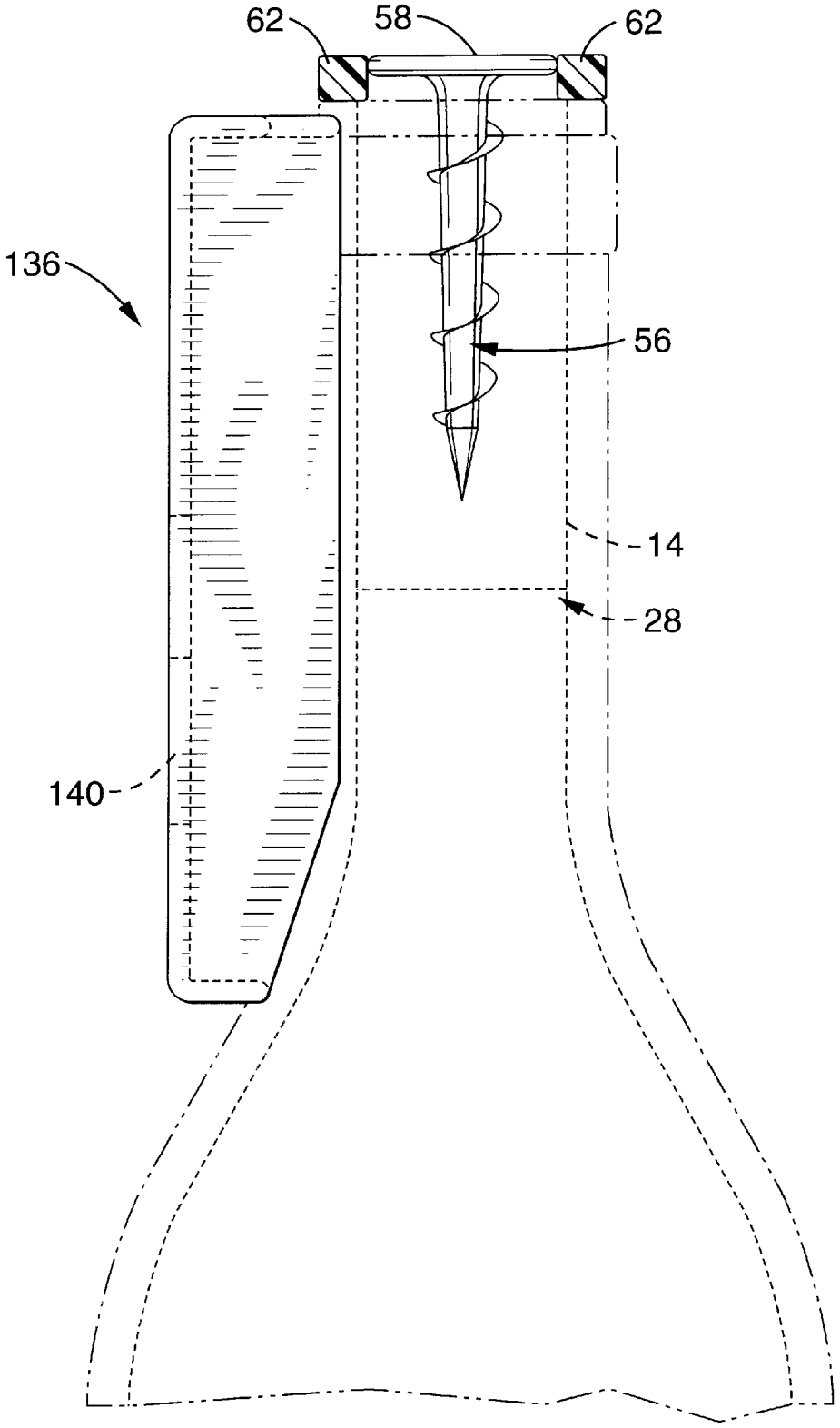
FIG. 37 is an elevation view of the cork removal apparatus shown in FIG. 34 stored alongside the neck of the bottle depicted in phantom, with the packaging ring shown in cross section.

An alternative embodiment of a simplified cork removal apparatus is shown assembled in FIG. 34, wherein a simple handle 136 with contours 138 and a slotted hole 140 are used to remove the cork by means of its attached anchor. The handle 136 shown in FIG. 34 is pulled directly up from the bottle to extract the cork. The contour of 138 mates with the side of the bottle for storage. A depiction of the handle separated from the cork and anchor is shown in FIG. 35. To attach the handle to the cork the head 58 of the anchor 56 is slipped up through the hole 140 and slid along the holes' slotted region so that a substantial contact surface between handle 136 and anchor head 58 is created. A cross section of the handle is shown in FIG. 36 taken through line 36—36 of FIG. 34. The extent to which the anchor head 58 is slid along the slot portion of the hole 140 is easily seen in this figure. The handle is shown stored alongside the neck of the bottle in FIG. 37. The contoured edges 138 of the handle 136 fit against the neck of the bottle. As in the previous embodiments using this anchor, a packaging ring 62 encircles the head 58 of the cork anchor 56 for safety and aesthetics.

Accordingly, it will be seen that this invention provides various embodiments of an integrated cork stopper/anchor assembly for a wine bottle, or the like, that can be removed using a cork-pulling handle capable of being packaged with the bottle or provided separately. The anchor can be installed in any type of cork including natural corks, agglomerated natural cork, synthetic corks, and others including plastic corks and the like. The cork-pulling handle can be packaged separately from the cork stopper/anchor assembly as shown with the hook and eye couplers and the raised head anchor and slot couplers described in the embodiments previously described, wherein the consumer makes the connection and pulls the cork. Alternatively, the cork-pulling handle can be permanently connected to the anchor using cords, straps or similar means. The cork pulling handle can be tied or otherwise secured to the bottle, or can be integrated with the wrapper or capsule that covers the neck of the bottle and seals the cork. In addition, the cork-pulling handle can be a completely separate detached component that is sold separately if desired. As can be seen from the discussion herein, the present invention provides for the quick and easy removal of a cork from a bottle without having to engage the cork with a separate corkscrew or other cork removal device. Although the description above contains many specifics, these should not be construed as limiting the scope of the invention but as merely providing illustrations of some of the presently preferred embodiments of this invention. Thus the scope of this invention should be determined by the appended claims and their legal equivalents.

What is claimed is:

1. A self-contained cork stopper and cork-pulling apparatus for cork-sealed bottles, comprising:

(a) a cork stopper, said cork stopper including a top and a bottom and at least one side;

(b) an anchor, said anchor including a threaded shank internally secured in said cork stopper and forming an integrated cork stopper/anchor assembly, wherein said anchor does not extend beyond said bottom of said cork stopper or protrude through the side of said cork stopper;

(c) a cork-pulling handle, said cork-pulling handle capable of being stored separately from said cork stopper/anchor assembly, said cork-pulling handle capable of being grasped by more than two fingers of a user to apply force required for removal of said cork stopper; and (d) a coupling on said anchor configured to accept the attachment of said cork-pulling handle.

2. An apparatus as recited in claim 1, wherein said cork stopper includes an internal pilot hole, wherein said anchor and threaded shank are received by said pilot hole.

3. An apparatus as recited in claim 1, wherein said cork-pulling handle is configured for attachment to a bottle sealed by said integrated cork stopper/anchor assembly for storage.

4. An apparatus as recited in claim 1, wherein said anchor is secured to said cork stopper during compression of said cork stopper during corking of a bottle sealed by said cork stopper/anchor assembly.

5. An apparatus as recited in claim 1, further comprising an annular packaging member positioned coaxially around a portion of said anchor which protrudes from said cork, whereby safety sealing, aesthetic enhancement, and a simplification of the overwrapping process may be facilitated.

6. An apparatus as recited in claim 1, wherein said coupling on said anchor comprises a generally planar portion of said anchor extending from the top of said cork that can be slidably engaged with a mating portion attached to cork-pulling handle.

7. An apparatus as recited in claim 1, wherein said coupling of said anchor for attachment of said cork-pulling handle comprises an aperture within said anchor and is engaged by an arcuate hook member attached to said cork-pulling handle that is of a size and shape so as to provide engagement with said anchor.

8. An apparatus as recited in claim 1, wherein said cork-pulling handle includes a lever arm wherein one portion of which is attached to said cork-pulling handle and another portion that may be disposed on bottle containing said cork stopper/anchor assembly, whereby coercion of the cork stopper/anchor assembly from said bottle may be accomplished with reduced pulling force as compared with a non-levered handle.

9. An apparatus for removing a cork from a bottle, comprising:

(a) a cork-pulling handle;

(b) an anchor capable of being inserting into and engaging a cork, said anchor including a threaded shank for inserting into and engaging said cork, said cork including a top and a bottom and at least one side, wherein said anchor does not extend beyond said bottom or protrude through said side; and (c) a coupling on said anchor configured to accept the attachment of said cork-pulling handle in an integrated cork/anchor assembly, said cork pulling handle capable of being grasped by more than two fingers of a user to apply force required for removal of said integrated cork/anchor assembly;

(d) wherein said cork-pulling handle is separate and detached from said cork/anchor assembly.

10. An apparatus as recited in claim 9, wherein said anchor and said threaded shank are received by a pilot hole in said cork.

11. An apparatus as recited in claim 9, wherein said cork-pulling handle is configured for attachment to a bottle sealed by said integrated cork/anchor assembly for storage.

12. An apparatus as recited in claim 9, further comprising a cord that couples said cork-pulling handle to said anchor.

13. An apparatus as recited in claim 9, wherein said anchor is secured to said cork during compression of said cork.

14. An apparatus for removing a cork from a cork-sealed bottle, comprising:

(a) an anchor, said anchor including a threaded shank for securing said anchor to a cork to produce an integrated cork/anchor assembly, said cork including a top and a bottom and at least one side, wherein said anchor does not extend beyond said bottom or protrude through said side; and (b) a cork-pulling handle, said cork-pulling handle including a coupling for engaging said anchor wherein anchor is configured to accept the attachment of said cork-pulling handle wherein said cork-pulling handle is capable of being grasped by more than two fingers of a user to apply force required for removal of said integrated cork/anchor assembly;

(c) wherein said cork-pulling handle can be stored separately from said anchor and said cork.

15. An apparatus as recited in claim 14, wherein said threaded shank is received by a pilot hole in said cork.

16. An apparatus as recited in claim 14, wherein said cork-pulling handle is configured for attachment to a bottle sealed by said integrated cork/anchor assembly for storage.

17. An apparatus as recited in claim 14, further comprising a cord that couples said cork pulling handle to said anchor.

18. An apparatus as recited in claim 14, wherein said anchor is secured to said cork during compression of said cork.

* * * * *